US009796567B2

(12) United States Patent
Krijnen

(10) Patent No.: US 9,796,567 B2
(45) Date of Patent: Oct. 24, 2017

(54) LINE STABILIZER

(71) Applicant: National Oilwell Varco, L.P., Houston, TX (US)

(72) Inventor: Anton Krijnen, Klundert (NL)

(73) Assignee: National Oilwell Varco, L.P., Houston, TX (US)

( * ) Notice: Subject to any disclaimer, the term of this patent is extended or adjusted under 35 U.S.C. 154(b) by 55 days.

(21) Appl. No.: 14/295,835

(22) Filed: Jun. 4, 2014

(65) Prior Publication Data

US 2015/0353331 A1 Dec. 10, 2015

(51) Int. Cl.
*B66D 1/36* (2006.01)

(52) U.S. Cl.
CPC ..... *B66D 1/36* (2013.01)

(58) Field of Classification Search
CPC ..... B66D 1/36; E21B 19/02
USPC ..... 254/389
See application file for complete search history.

(56) References Cited

U.S. PATENT DOCUMENTS 1,049,170 A 12/1912 Thomas
1,471,583 A * 10/1923 Andersen ..... F16N 7/00 184/15.1
1,509,906 A 9/1924 Goss
1,849,924 A * 3/1932 Hall ..... E21B 19/02 24/136 A
1,896,415 A * 2/1933 McDonald ..... E21B 19/02 188/65.5
2,190,880 A * 2/1940 Moss ..... E21B 19/02 242/157 R
2,238,398 A * 4/1941 Reed ..... E21B 19/02 242/157 R
2,316,727 A * 4/1943 Thompson ..... B66B 7/06 242/157.1
2,329,529 A 9/1943 Gwinn
2,480,488 A * 8/1949 MacClatchie ..... B65H 57/14 242/157.1
2,486,071 A 10/1949 Smith
2,495,039 A 1/1950 Tuel
2,529,486 A 11/1950 Clarkson
2,565,693 A * 8/1951 Lewis ..... E21B 19/02 242/149
2,681,793 A * 6/1954 Miller ..... E21B 19/02 242/157.1
2,695,770 A * 11/1954 Stone ..... E21B 19/02 15/220.4
3,295,832 A 1/1967 Fowler
(Continued)

OTHER PUBLICATIONS

"Wire Line Guides Parts and Price List", Byron Jackson Tools, Inc. Oil Field Tools, Oil Field Rubber Products, and Oil Field Pumps Catalog, 1959 (3 pages).

(Continued)

*Primary Examiner* — William E Dondero
(74) *Attorney, Agent, or Firm* — Winthrop & Weinstine, P.A.

(57) ABSTRACT

A stabilizer for a line may include a guide configured for arrangement on the line to resist and/or dampen lateral motions of the line where the guide may include a guide jacket having a static sleeve configured to allow the line to pass through the guide and a fortifying bracket configured to reinforce the guide jacket and configured to interface with a hanging system to support the guide jacket and maintain the guide jacket in position on the line.

17 Claims, 23 Drawing Sheets

(56) References Cited

U.S. PATENT DOCUMENTS

| | | | | |
|---|---|---|---|---|
| 3,951,235 | A | 4/1976 | Acerbi | |
| RE29,493 | E | 12/1977 | Crump | |
| 4,106,156 | A * | 8/1978 | Fisher | B65H 57/12 16/108 |
| 4,169,427 | A | 10/1979 | Crump et al. | |
| 4,296,837 | A | 10/1981 | Charlton | |
| 4,336,866 | A | 6/1982 | Blanton, Jr. | |
| 4,498,558 | A | 2/1985 | Bendahan | |
| 4,862,996 | A | 9/1989 | Chisholm | |
| 5,645,269 | A | 7/1997 | Peterson | |
| 5,941,653 | A | 8/1999 | Cipriani | |
| 6,234,277 | B1 | 5/2001 | Kaczmarek | |
| 6,471,191 | B1 * | 10/2002 | Rotzler | B66D 1/36 226/196.1 |
| 6,783,593 | B2 | 8/2004 | Selcer et al. | |
| 7,222,840 | B1 | 5/2007 | Stepper | |
| 7,475,867 | B1 * | 1/2009 | Romo | B63B 21/10 242/157 R |
| 8,047,506 | B2 | 11/2011 | Student et al. | |
| 8,317,160 | B2 | 11/2012 | Romo et al. | |
| 8,511,645 | B2 * | 8/2013 | Taddei | B66D 1/38 254/278 |
| 9,249,643 | B2 | 2/2016 | Melancon | |
| 2007/0278465 | A1 | 12/2007 | Letellier | |
| 2014/0291030 | A1 * | 10/2014 | Urquhart | E21B 19/24 175/203 |
| 2015/0353331 | A1 | 12/2015 | Krijnen | |
| 2016/0122163 | A1 | 5/2016 | Krijnen | |

OTHER PUBLICATIONS

"Assembly, Wire Line Guide Roller Type", internal Varco B.J. Drilling Systems drawing for fabrication purposes, dated Nov. 15, 1990 (1 page).

"Stabilizer Assembly", internal National Oilwell Varco drawing for fabrication purposes, dated Nov. 12, 2007 (1 page).

International Search Report and Written Opinion for related PCT Application No. PCT/US2015/062896 mailed Aug. 3, 2016 (12 pages).

* cited by examiner

LINE STABILIZER

FIELD OF THE INVENTION

The present disclosure relates to a stabilizer or guide for managing relative movement with a line such as a wire, guide wire, guideline, cable, cord, rope, wire rope or other relatively flexible tension carrying element. More particularly, the present disclosure relates to a stabilizer for permitting movement of the line through the stabilizer while reducing, damping, controlling, or otherwise inhibiting lateral motion or whipping of the line. Still more particularly, the present disclosure relates to a fast line stabilizer for use on a fast line or wire line of an oil derrick where the lifting line extends from the winch or drum upward toward the crown block of the derrick.

BACKGROUND OF THE INVENTION

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

A derrick cable is traditionally used to raise and lower a lifting hook. A lifting hook is often present on a travelling block that is part of a block and tackle arrangement on the derrick. The travelling block may be suspended below a crown block via a plurality of outgoing and returning portions of the derrick cable that is reeved through the traveling and crown blocks. Due to this reeving arrangement, in order to raise and lower the hook at a given speed, the derrick cable must spool on and off a drum at a much higher speed. In some cases, the derrick cable may be spooled on and off the drum at speeds of about 50 to 60 mph. This fast moving line may often have a tendency to sway, wave, or whip laterally relative to the longitudinal motion of the line.

A stabilizer may be positioned on the line, may be suspended from above, and may be positioned laterally by a triangle cabling setup. The triangle cabling may allow the stabilizer and line to move to the left and right along the axis of a winch drum as the cable is spooled on and off the drum. The stabilizer may provide a damping effect on the side-to-side swinging of the derrick cable. However, traditional stabilizers are cumbersome and have many parts often including plates and supported wheels with axles, bearings, and the like. Some stabilizers are known to have 77 different parts and are prone to losing or dropping the parts while in use. The objects may easily become projectiles as they are flung in any direction at very high speeds. Still further, such failures may occur without warning. This can be dangerous for crews and can damage equipment.

BRIEF SUMMARY OF THE INVENTION

The following presents a simplified summary of one or more embodiments of the present disclosure in order to provide a basic understanding of such embodiments. This summary is not an extensive overview of all contemplated embodiments, and is intended to neither identify key or critical elements of all embodiments, nor delineate the scope of any or all embodiments.

In some embodiments, a stabilizer for a line may include a guide configured for arrangement on the line to resist and/or dampen lateral motions of the line. The guide may include a guide jacket having a static sleeve configured to allow the line to pass through the guide. This embodiment and other embodiments disclosed herein may be particularly advantageous due to the reduced number of parts when compared to known devices having roller cages surrounding the cable with pulleys, pins, bearings, etc. The reduced number of parts of the present embodiments reduces the chances for dropped or thrown parts to occur. Accordingly, the use of a static sleeve-type system may be substantially safer and less prone to cause injury or damage of surrounding equipment or equipment below the stabilizer.

In some embodiments, the guide may also include a fortifying bracket configured to reinforce the guide jacket. The guide jacket or fortifying bracket may also be configured to interface with a hanging system to support the guide jacket and maintain the guide jacket in position on the line. The guide may be secured in place with a hang line assembly, for example, such that waving, whipping, or other lateral motions of the line may be substantially controlled and/or contained. In one particular example, the guide may be used for a derrick cable that extends upward from a winch drum to a crown block on an oil rig, for example.

In some additional embodiments, a method for creating a stabilizer for a line may be provided where the stabilizer includes a guide jacket and a fortifying bracket. The method may include placing the fortifying bracket into a guide jacket mold wherein the fortifying bracket is configured to reinforce the guide jacket and is also configured to interface with a hanging system to support the guide jacket and maintain the guide jacket in position on the line. In addition, the guide jacket mold is configured to form a guide jacket having a sleeve configured to allow the line to pass through the guide. The method may also include feeding a material into an injection mold machine and injecting the material into the mold to for the guide jacket while encasing the fortifying bracket with the material. In other embodiments, the guide jacket and the fortifying bracket may be formed separately and mechanically fastened such that the fortifying bracket contains the guide jacket.

While multiple embodiments are disclosed, still other embodiments of the present disclosure will become apparent to those skilled in the art from the following detailed description, which shows and describes illustrative embodiments of the invention. As will be realized, the various embodiments of the present disclosure are capable of modifications in various obvious aspects, all without departing from the spirit and scope of the present disclosure. Accordingly, the drawings and detailed description are to be regarded as illustrative in nature and not restrictive.

BRIEF DESCRIPTION OF THE DRAWINGS

While the specification concludes with claims particularly pointing out and distinctly claiming the subject matter that is regarded as forming the various embodiments of the present disclosure, it is believed that the invention will be better understood from the following description taken in conjunction with the accompanying Figures, in which:

DETAILED DESCRIPTION

The present disclosure, in some embodiments, relates to a line stabilizer for positioning along a line and for controlling lateral motions of the line. In particular, in some embodiments, the stabilizer may be for use with a fast line or wire line of an oil derrick where the line coming off of the winch drum may be moving at high speeds and may have a tendency to wave, whip, or otherwise move laterally relative to the direction of motion of the line. The presently described stabilizer may be designed with fewer parts assembled in a manner particularly adapted to reduce and/or prevent the number of dropped objects. For example, in lieu of rollers or other moving parts, in some embodiments, the stabilizer may include dedicated wear parts to safe guard primary functions and parts and the dedicated wear parts may include indicators allowing the user to determine the amount of wear on the part such that informed decisions about repair and/or replacement may be made before parts fall or other failures occur. In this manner, fewer parts may be used to construct the stabilizer and, though potentially consumable, indications of wear may allow for ready replacement and/or scheduled or anticipated replacement rather than unexpected failures or drops.

Figure 1:
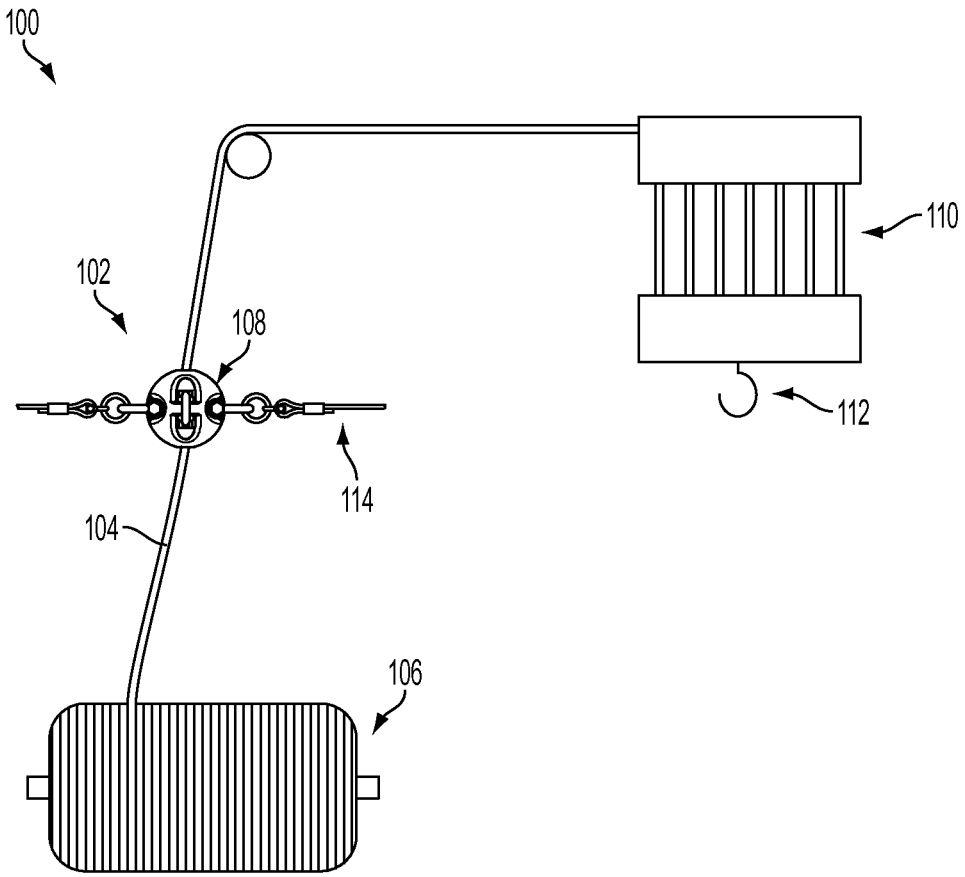
FIG. 1 is a schematic diagram of a stabilizer on a wire line of a drill platform, according to an embodiment of the present disclosure.

Referring to FIG. 1, a stabilizer 102 may be used on a drilling platform 100, for example. The drilling platform may include a winch 106 with a wire line 104 wrapped thereon and extending therefrom. The wire line 104 may extend upward from the drum to a crown block and may be reeved through the crown block and travelling block to form a block and tackle arrangement. In order to raise or lower the hook 112, the block and tackle 110 may be drawn shorter or extended, respectively. Depending on the reeving and the number of ropes within the block and tackle arraignment 110, the derrick cable 104 may be spooled on and off the drum 106 at a much faster speed than the hook will raise or lower. For example, the derrick cable 104 may travel at speeds ranging from 50 to 60 mph. The stabilizer 102 may be used to damp side-to-side motion of the derrick cable 104 and one or more stabilizers 102 may be positioned along the wire line 104 for this purpose.

The stabilizer 102 may be constructed with one or more components, including but not limited to, a guide 108 and a hang line assembly 114. The guide 108 may include an opening through which the derrick cable 104 may be securely guided while being spooled on and off the drum 106. The hang line assembly 114 may attach or secure the guide to one or more fixed points on the drill platform 100 or superstructure. The hang line assembly 114 may also affix the guide 108 to, or include, a triangle cabling setup, which may allow for some limited side to side movement in order to facilitate the spooling of the derrick cable 104 on and off the drum 106. In conjunction, the guide 108 and hang line assembly 114 may withstand the potentially violent whipping or waving of the wire line and dampen its lateral motions.

As will be appreciated in reviewing the presently disclosed embodiments, many fewer parts may be used in the present embodiments when compared to previously known assemblies of rollers and cages. As such, a much safer work environment may be provided because the present embodiments have fewer items that can potentially fall from or be thrown from the stabilizer.

Figure 2:
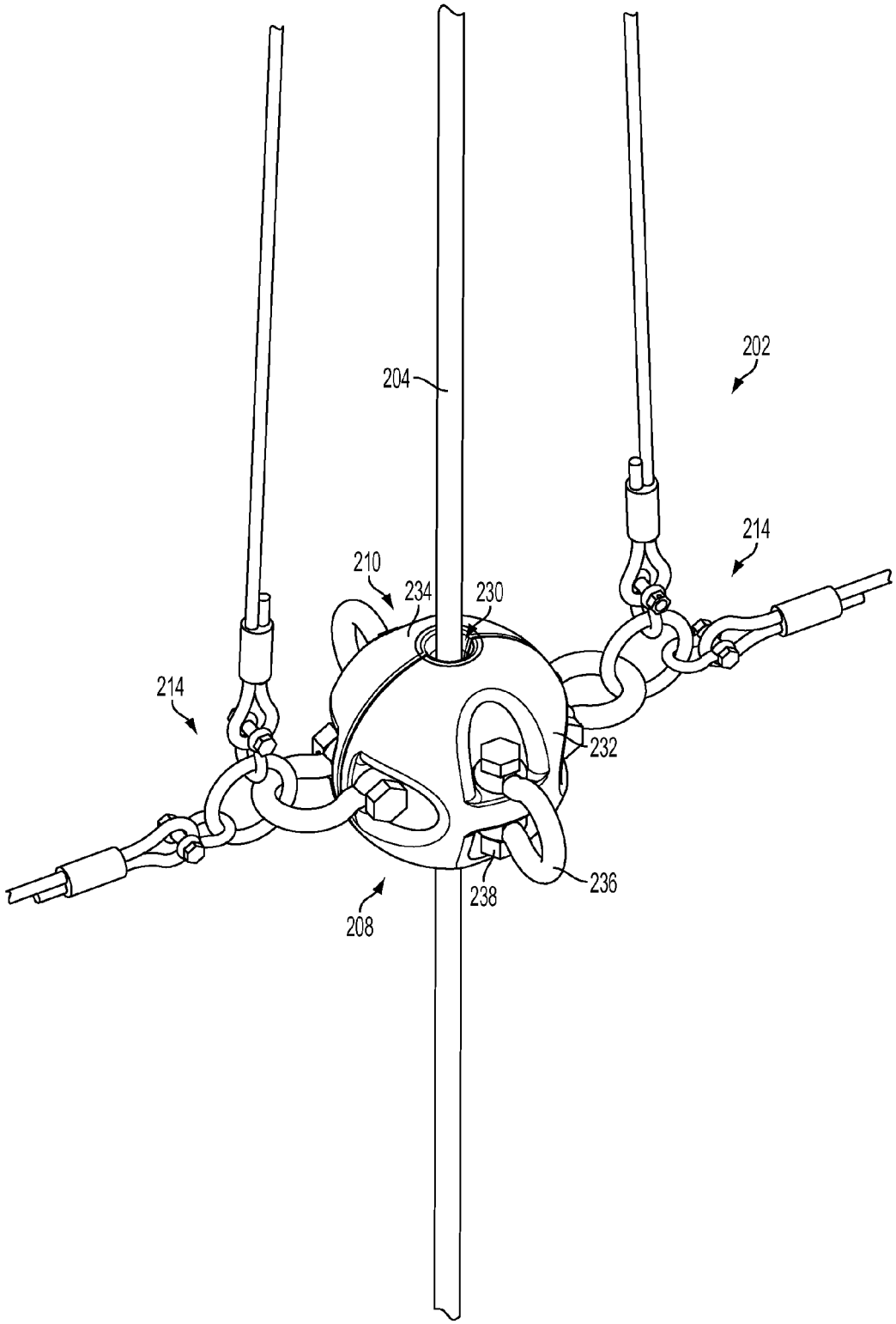
FIG. 2 is perspective view of stabilizer, according to one or more embodiments of the present disclosure.
Figure 3:
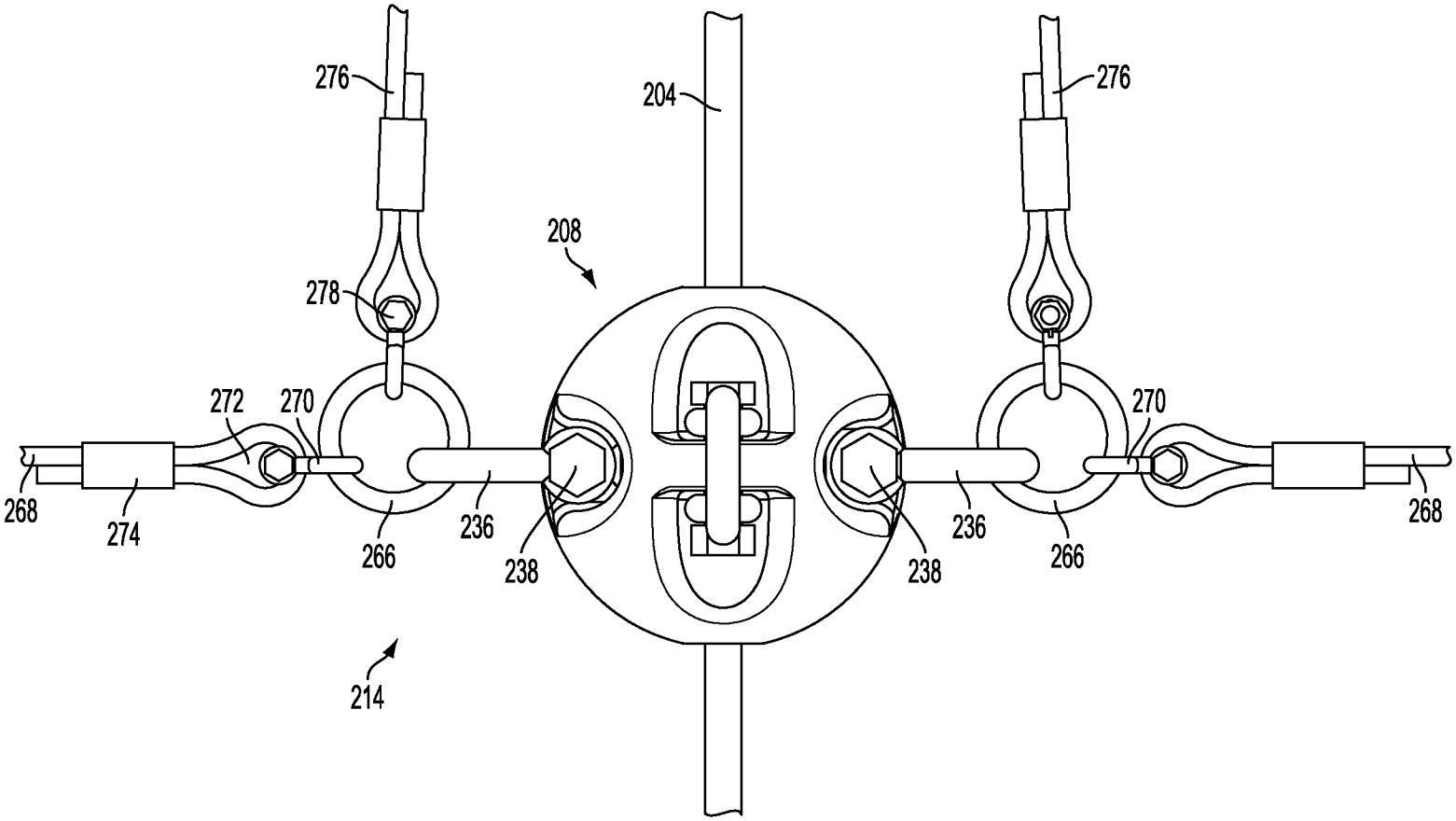
FIG. 3 is a side view of the stabilizer of FIG. 2 including an attached hang line assembly, according to one or more embodiments of the present disclosure.
Figure 3A:
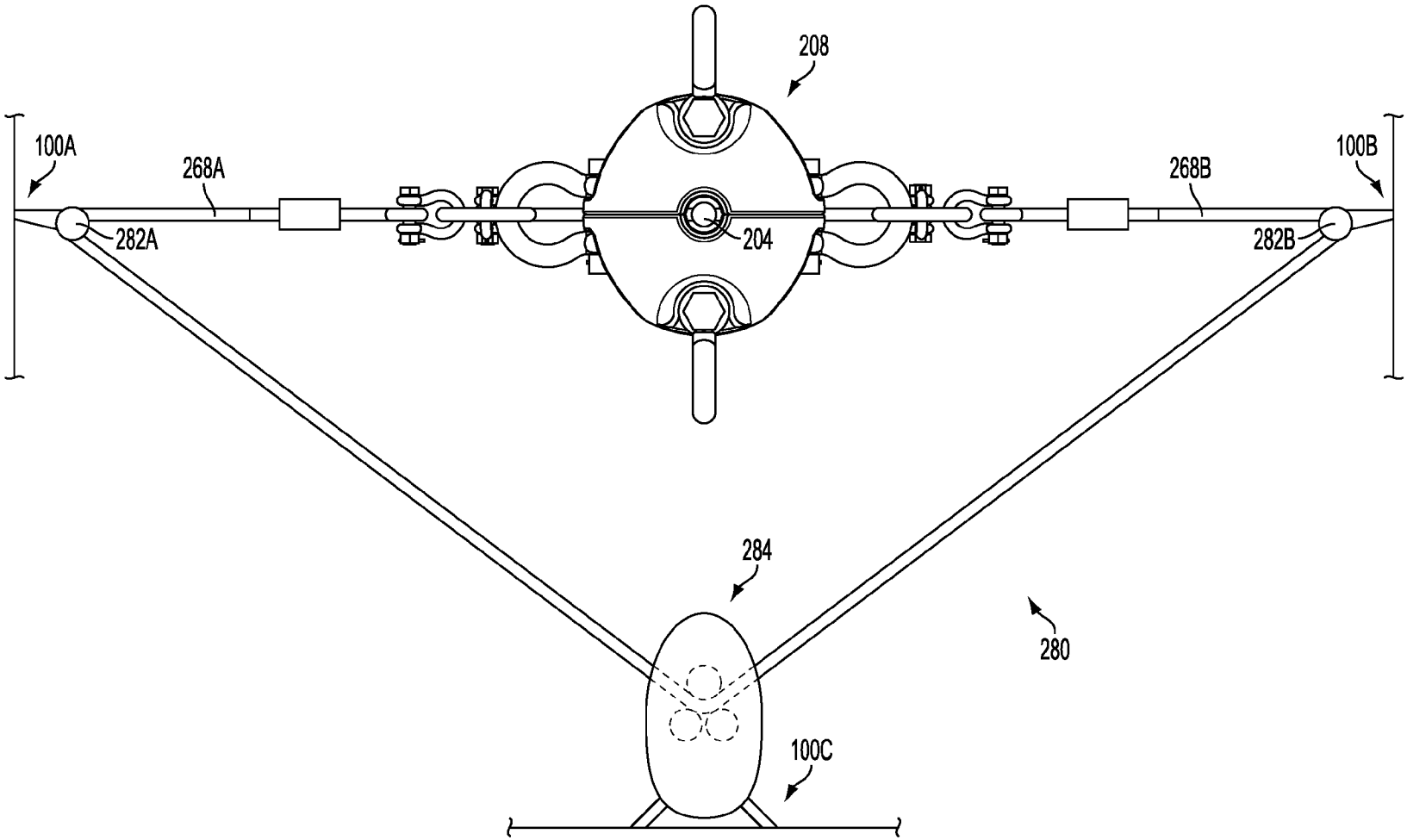
FIG. 3A is top view of the stabilizer and hang line assembly of FIG. 3.

While a stabilizer 102 is shown in FIG. 1, several types of stabilizers may be provided. In one embodiment, as shown in FIGS. 2-3A, a generally spherical stabilizer may be provided. As shown, the stabilizer 202 may generally include a guide 208 and a hang line assembly 214. The guide 208 and hang line assembly 214 may function together to force the wire line to pass through a defined or semi-defined point above the winch drum so as to control the waving or whipping motions of the wire line 204. In various embodiments, the fast line stabilizer may also include a secondary stabilizer and secondary stabilizer assembly as discussed below and with respect to FIGS. 4 and 4A.

Figure 2A:
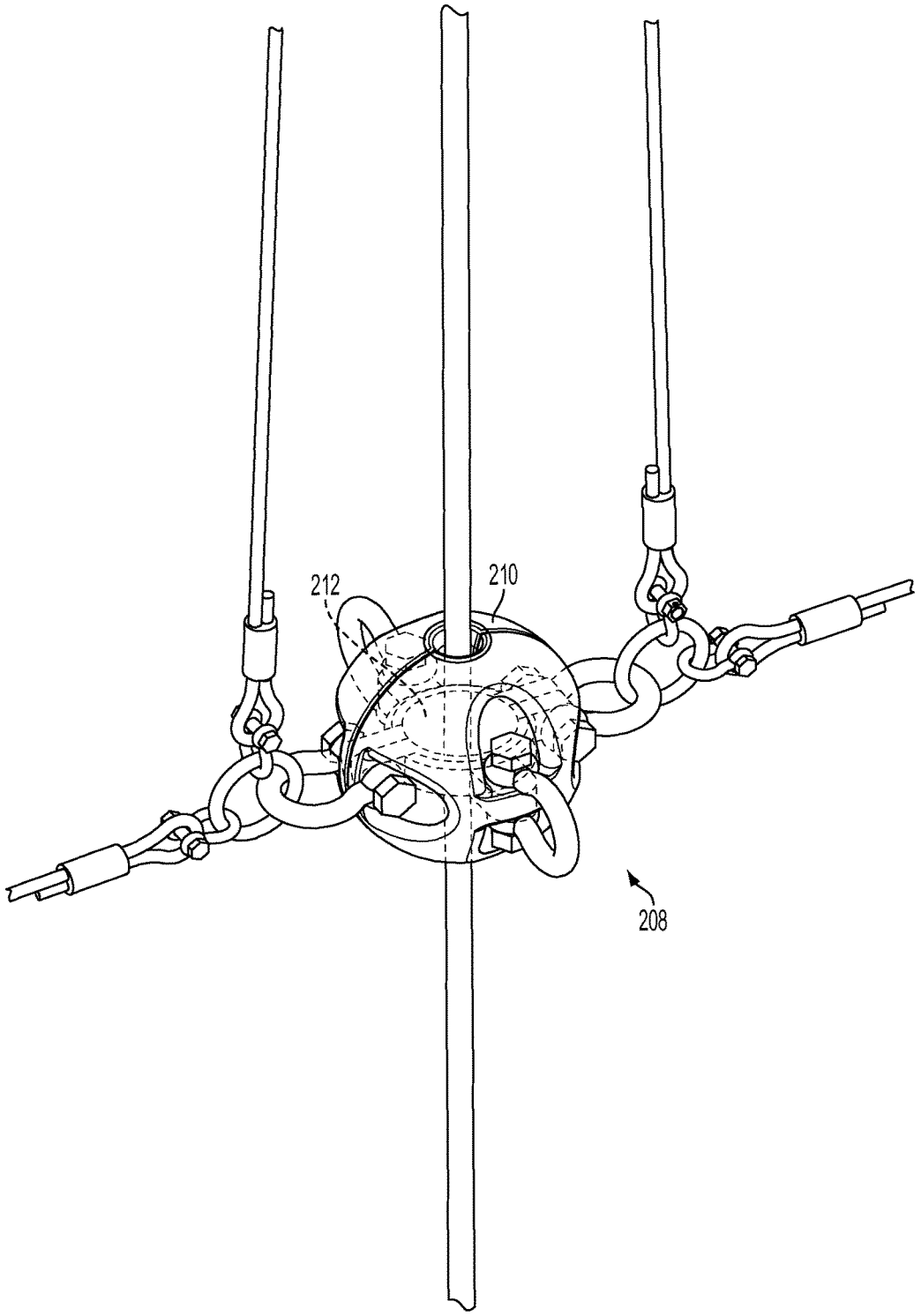
FIG. 2A is a perspective and semi-transparent view of the stabilizer of FIG. 2.

Generally, as seen in FIG. 2, the guide 208 may be arranged around the derrick cable 204 (also referred to interchangeably herein as fast line or whip line or wire line), such that the derrick cable 204 may pass substantially freely through the guide 208. As such, the guide may be configured to physically engage the cable 204 while also allowing the cable to quickly pass therethrough as it is paid out or hauled in by the winch. However, in an effort to reduce the number of parts of the system, the guide may be a substantially static component or may have a substantially static sleeve for engaging the line as opposed to known roller-type approaches. As such, this and other embodiments of the present disclosure may be constructed with substantially fewer parts providing for a substantially safer environment where chances of dropped or thrown elements of the stabilizer are lessened. As shown in the translucent view of FIG. 2A, the guide 208 may include a guide jacket 210 and a fortifying bracket 212.

Figure 2B:
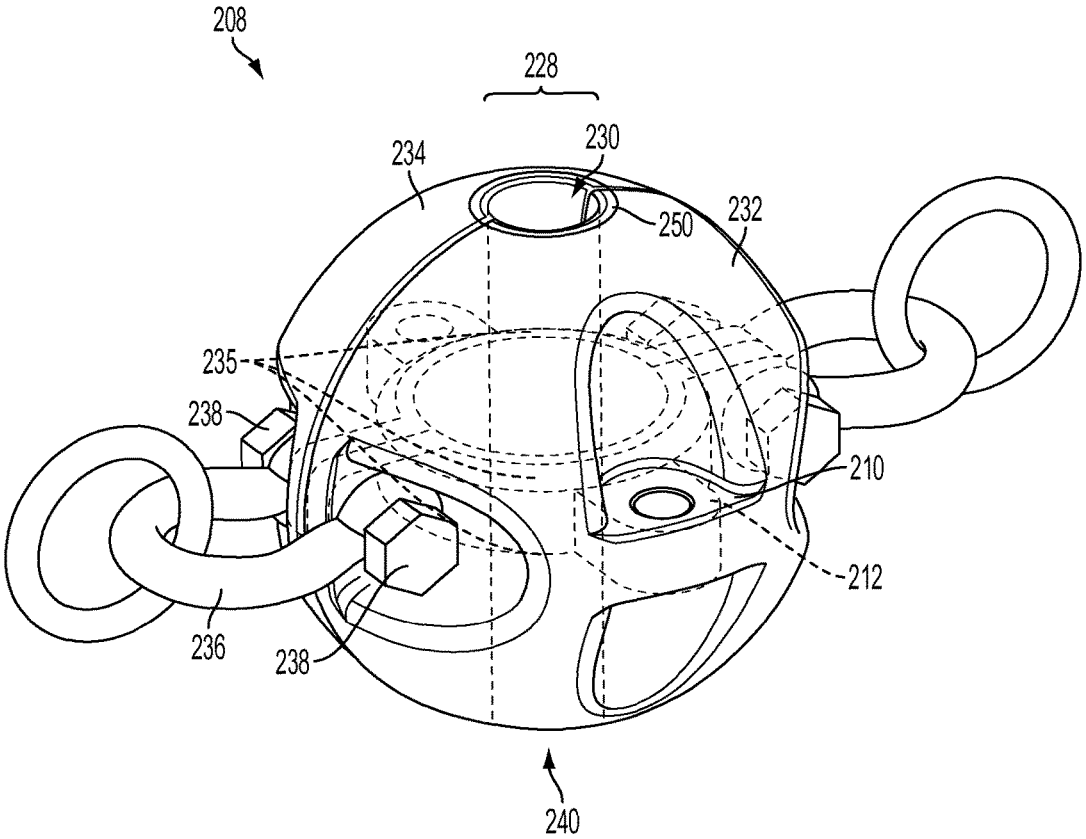
FIG. 2B is a close-up view of the guide of the stabilizer in FIG. 2A.

The guide jacket 210 may be configured for arrangement around the derrick cable 204 and for physical sliding engagement with derrick cable to provide guidance and damping effects. The guide jacket 210 may include one or more jacket components 232, 234. As illustrated in FIG. 2, the guide jacket 210 may include two jacket components 232, 234. In other embodiments, the guide jacket 210 may include any number of jacket components. As illustrated in FIG. 2B, the jacket components 232, 234 may cooperate to define a sleeve 228 having a top opening 230, a bottom opening 240, and a hollow tube or lumen 235 between the top opening 230 and bottom opening 240. The sleeve 228 may have a diameter greater than the diameter of the derrick cable, in various embodiments.

Figure 2C:
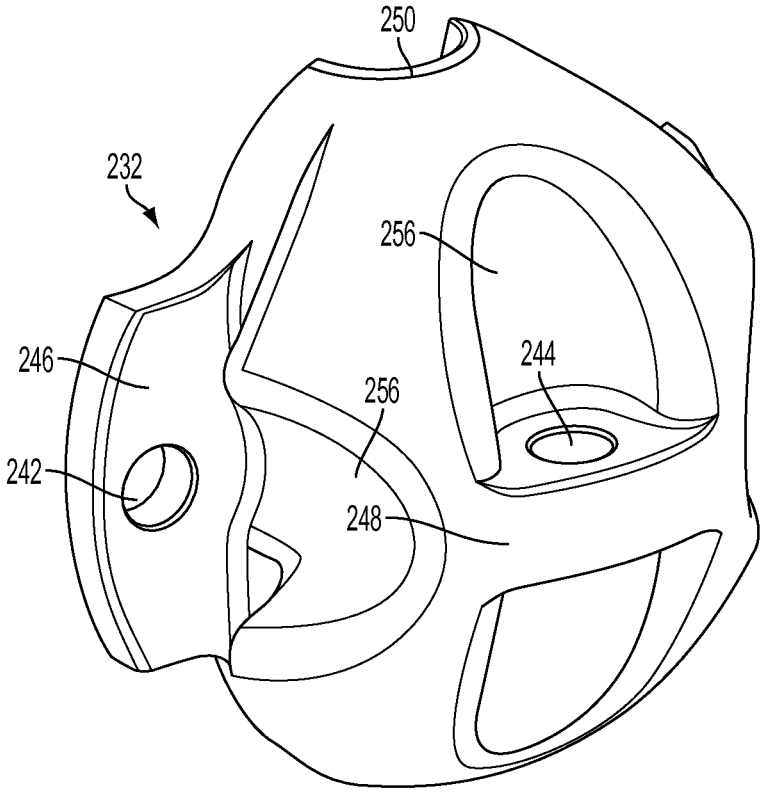
FIG. 2C is a perspective view of a guide jacket component of the stabilizer of FIG. 2.

As seen in the embodiment of FIG. 2C, a jacket component 232 may generally be spherical in shape. That is, the outer surface may generally be curved and may follow a substantially constant radius, for example. The inner surface may be configured to align with one or more other jacket components, thereby forming the guide jacket 210. A jacket component 232 may comprise one or more structural features. In one embodiment, the jacket component 232 may comprise one or more eyelet fingers 246, one or more eyelet thumbs 248, one or more eyelets 242, 244, one or more securing grooves 256, and one or more wear marks 250.

An eyelet finger 246 may be configured to generally align with an eyelet finger on another jacket component. In one embodiment, the eyelet finger 246 may be a generally flanged element having a flat surface, as seen in FIG. 2C. The eyelet finger 246 may generally be located on an edge between the inner and outer surface of a jacket component 232. The eyelet finger 246 may comprise one or more jacket securing eyelets 242.

An eyelet thumb 248 may protrude, or be generally located, on the outer surface of the jacket component 232. As seen in FIG. 2C, a securing groove 256 may create a protruded surface, or eyelet thumb 248. The securing grooves 256 may be configured to easily connect bolts, shackles, and other components onto the guide 208 using the eyelets 242 and 244. The eyelet thumb 248 may comprise one or more hang line assembly eyelets 244. The hang line assembly eyelet 244 may be configured, in conjunction with one or more securing mechanisms, to mechanically connect one or more assembly components to the guide 208. In other embodiments, there may be no securing grooves and the eyelet thumb 248 may be a generally flat surface that protrudes from the guide 208.

The jacket component 232 may be generally aligned with another jacket component, such as a mirror image of jacket component 232, to form the guide jacket 210. The jacket securing eyelet 242, and its corresponding mirror image counterpart may be configured to facilitate the mechanical connection of two jacket components. As seen in FIG. 2B, the jacket component 232 may be mechanically connected with jacket component 234. A bolt (also referred to interchangeably herein as a pin, screw, or fastener) 238 may be configured to connect jacket component 232 and 242 by threading through the jacket securing eyelets 242. As seen in FIG. 2, a guide shackle 236 may additionally be mechanically connected to the jacket component 232 using the bolt 238.

The assembled jacket components may define the sleeve 228 with top and bottom openings 230/240. In some embodiments, as discussed in the discussion of FIGS. 5-5H, the sleeve 228 may have a generally constant bore diameter over a portion of its length with flared or conically shaped ends such that diameter of the sleeve increases as it approaches the surface of the jacket. In other embodiments, the bore diameter may be substantially constant over substantially the full length of the jacket.

Figure 2D:
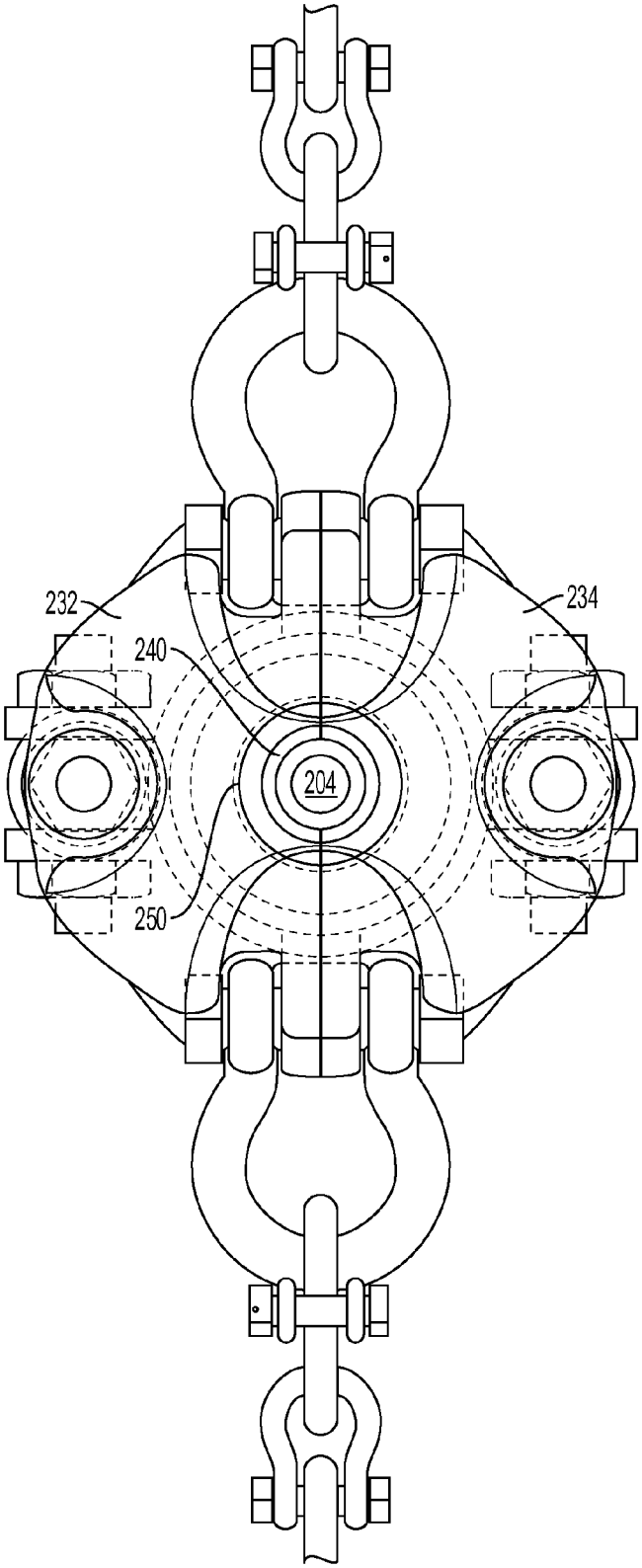
FIG. 2D is a top view of the guide portion of the stabilizer of FIG. 2.

The guide jacket, and its corresponding jacket components, may be made from one or more materials, including but not limited to, a durable and wear resistant plastic/compound, hardened steel, alloy, or other material. It is understood that any suitable material, or combination of materials, may be used. Referencing FIG. 2B, the wear resistant plastic may or may not wear as the derrick cable slides through the guide sleeve 228. A wear mark or wear groove 250 may be used to indicate the amount of wear the guide 208 has experienced and when the guide jacket or jacket components should be replaced. As seen in FIG. 2B, 2C, a wear mark 250 may be placed laterally to the opening 230. In addition, as seen in the bottom view of FIG. 2D, a wear mark 250 may be placed lateral to the opening 240. For example, in one embodiment, the wear mark 250 may be a circular mark placed on a three inch radius from the center of the opening 230, 240. In some embodiments, for example, the opening 230, 240 may have a radius of two and one half inches (i.e., 5 inch diameter) and the wear mark 250 may be placed one half of one inch from the opening 230, 240 such that the wear mark has a six inch diameter. The opening 230, 240 may slowly expand in diameter as the derrick cable 204 slowly causes the guide jacket to wear. When the opening 230, 240 grows to a three inch radius, the wear mark 250, or portions thereof, may substantially disappear, indicating the guide jacket or jacket components 232, 234 should be replaced. The radius of the wear mark and/or the openings 230, 240 may be selected based on the size and type of derrick cable being accommodated and the wear resistance of the guide jacket. Still further, any suitable wear indicator, marking, or groove may be used to allow a user to quickly recognize the amount of wear that has occurred and/or the amount of wear that remains.

In various embodiments, the sleeve 228 walls may comprise the wear resistant plastic, however, the walls of the sleeve may not notice the same wear as other parts of the guide 208. That is, for example, the device may have a tendency to wear more quickly at the openings 230 and 240, and thus the wear indicator, or wear mark 250, may be located lateral to the openings 230, 240. It should be understood that a wear mark may be located in any suitable location. It should be further understood that the walls of the sleeve 228 may be comprised of any suitable material. In some embodiments, the guide may be constructed with several material layers where high wear areas have higher wear resistant materials and other areas have softer or less wear resistant materials.

The fortifying bracket may generally be arranged around the derrick cable and may be configured for reinforcing the guide jacket and for transferring forces through the guide. The fortifying bracket may be configured to allow the guide to withstand the pulling forces initiated by the derrick cable as it slams sideways in all directions in addition to the tensile forces imparted by the hang line system. It is to be appreciated as shown in later described embodiments that where the guide jacket is made from more robust materials such as steel or an alloy, the fortifying bracket may be omitted. However, in the present embodiment, the fortifying bracket may include one or more bracket components. As illustrated in the cross sectional view of FIG. 2E, the fortifying bracket 212 may include two bracket components 252, 254. In other embodiments, the fortifying bracket 212 may include any number of bracket components. In some embodiments, the number of fortifying brackets may be coordinated with the number of jacket components 232, 234 such that the number of each matches that of the other. The bracket components 252, 254 may generally cooperate to define a central opening 258. The central opening 258 of the fortifying bracket 212 may have a diameter greater than the diameter of the sleeve 228 of the guide jacket 210, in some embodiments. In other embodiments, the diameters may be equal.

The bracket components 252, 254 may be mirror images of each other, in some embodiments. In other embodiments, the bracket components may be any shape. The bracket components 252, 254 may have one or more eyelets. The bracket component eyelets may include, but are not limited to, a bracket securing eyelet 262 and a hang line assembly eyelet 264. The bracket component 252 may be configured to generally align with bracket component 254, such that the bracket securing eyelets 262 align. The bracket component 252 may be configured to mechanically connect to bracket component 254 using a bolt 238. The bracket components 252, 254 may also have one or more hang line assembly eyelets 264. The hang line assembly eyelet 264 may be configured to mechanically connect the hang line assembly 214 or secondary guide assembly to the guide 208, discussed below.

Figure 2E:
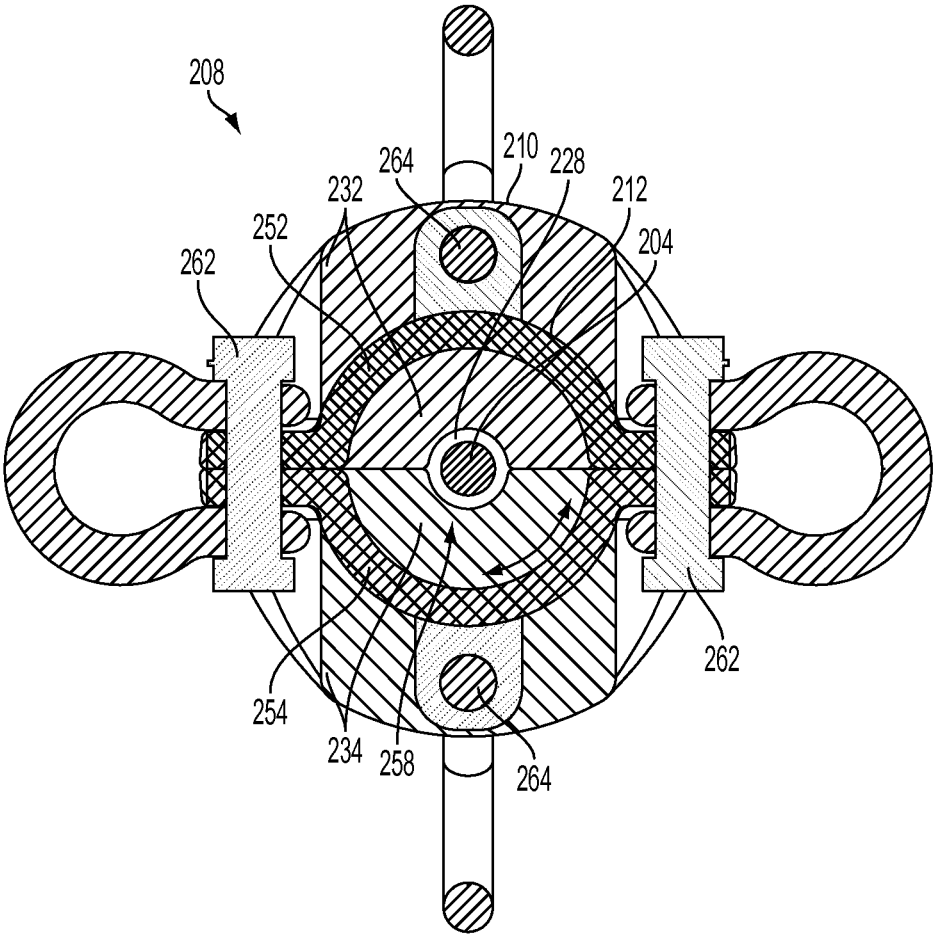
FIG. 2E is a cross-sectional view of the guide portion of the stabilizer of FIG. 2.

The fortifying bracket 212 may be incorporated into the guide jacket 210, in some embodiments. That is, the bracket component 252 may be substantially housed within the jacket component 232. As seen in FIG. 2E, the bracket component 252 may be entirely surrounded by the jacket component 232 such that the fortifying bracket may function to reinforce and/or strengthen the guide jacket 210. The bracket securing eyelets 262 may substantially align with the jacket securing eyelets 242. Likewise, the hang line assembly eyelets 244 and 264 may also substantially align.

The fortifying bracket, and its corresponding bracket components, may be made from one or more materials, including but not limited to, maraging steel, stainless steel, steel iron-nickel, Inconel, tool steel, nickel, iron, titanium, any other suitable metal or metal alloy, or any combination thereof. It is understood that any suitable material, or combination of materials, may be used.

Referring now to FIG. 3, the hang line assembly 214 may be configured to mechanically connect the guide 208 to one or more points on the drill platform or other structure. The hang line assembly 214 may include one or more components. In one embodiment, the hang line assembly components include, but are not limited to, a guide hook or guide shackle 236, a ring 266, a hang line shackle 270, and a hang line 268. In various embodiments, the hang line assembly 214 may also include a triangle cable setup.

As discussed above, a guide shackle 236 may be configured to mechanically attached to the guide 208 using a bolt 238 at one or more eyelets. In various embodiments, the guide shackle 236 may be a bolt-type D-Shackle. In other embodiments, the guide shackle 236 may be, but is not limited to, a pin type D-shackle, a screw pin anchor shackle, a round pin anchor shackle, a bolt-type anchor shackle, a round pin chain shackle, a screw pin chain shackle, a bolt-type chain shackle, a bow shackle, an anti-toppling shackle, or any other suitable substitute.

In various embodiments, a ring 266 may be configured to mechanically connect to the guide shackle 236. The ring 266 may allow for one or more hang lines 236 to connect to each guide shackle 236. In various embodiments, the ring 266 may be a closed loop, and therefore may be threaded onto the guide shackle 236 prior to the guide shackle 236 being mechanically connected to the guide 208. In other embodiments, the ring 266 may be configured such that it may be mechanically detached from the guide shackle 236 without removing the guide shackle 236 from the guide 208. The ring 266 may also allow for limited rotation and flexibility in the hang line assembly 214. In some embodiments, the ring 266 may be relatively rigid such that it substantially retains its shape under load. In other embodiments, the ring 266 may be relatively flexible and may stretch or change shape under load. The ring may be comprised of one or more materials including, but not limited to, steel, titanium, plastic, rubber, any other suitable material, or any combination thereof.

Similar to the guide shackle 236, a hang line shackle 270 may also be mechanically connected to the ring 266. In various embodiments, one or more hang line shackles may be used. The hang line shackle 270 may be linked around the ring 266. In various embodiments, the hang line shackle 270 may be a bolt-type D-Shackle. In other embodiments, the hang line shackle 270 may be, but is not limited to, a pin type D-shackle, a screw pin anchor shackle, a round pin anchor shackle, a bolt-type anchor shackle, a round pin chain shackle, a screw pin chain shackle, a bolt-type chain shackle, a bow shackle, an anti-toppling shackle, or any other suitable substitute.

The hang line 268 may be configured to connect the guide 208 to one or more fixed locations on the drill platform. In various embodiments, the hang line 268 may mechanically connect to the hang line shackle 270. In one embodiment, the hang line eyelet 272 may be configured to be thread through the hang line shackle 270 before securing it with a bolt, pin, or screw. The hang line 268 may have a hang line eyelet 272 which may be configured to mechanically connect to the hang line shackle 270. A wire rope swage 274 may be configured to secure the hang line 268 back on itself, thus creating the hang line eyelet 272. It is understood that any suitable method to create a hang line eyelet 272 may be used.

In one embodiment, the hang line 268 may mechanically connect directly to the hang line shackle 270. However, one skilled in the art may recognize that in various embodiments, the hang line 268 may mechanically connect directly to the ring 266, the guide shackle 236, or to any other suitable structure. One skilled in the art may understand that any suitable method to connect the hang line 268 to the hang line shackle 270, ring 266, guide shackle 236, or guide 208 may be used.

Referring to FIG. 3A, a triangle cabling setup 280 may be configured to connect the guide 208 to one or more fixed points 100A, 100B, and 100C. A hang line 268A, 268B may be generally connected to opposite sides of the guide 208. The hang line 268A, 268B may be configured such that it may be strung through a left spool 282A, a central spool 284, and a right spool 282B. A spool may herein be referred to interchangeably as a snatch block. The triangle cabling setup 280 may be configured to allow the guide 208 to move left and right in a substantially controlled manner. For example, as the derrick cable 204 is being spooled it may exert a force in the direction of fixed point 100A. As forces are exerted on the guide 208 to move toward 100A, the hang line cable 268A may shorten and the hang line 268B may lengthen, thereby allowing the guide 208 to move left. Conversely, as the derrick cable 204 exerts a force in the direction of fixed point 100B, the hang line cable 268B may shorten, hang line cable 268A may lengthen, and the guide 208 may be moved to the right. By allowing limited and controlled movement of the guide 208, the guide 208 may adjust its position based on the location at which the wire line is being spooled on and off of the drum. In addition, the guide 208 may experience less wear as the derrick cable may rub against the sides of the guide sleeve with less frequency or with less friction when compared to a guide that is not positioned in line with the location at which the line is spooled on and off of the drum.

The hang line assembly 214 may also have an anchor hang line 276 that may connect to a fixed point but not be part of a triangle cabling setup 280. Similar to the hang line 268, the hang line 276 may connect to the ring 266 using a hang line bolt and shackle 278.

The guide 208 that is installed using a triangle cabling setup 280 and/or anchor hang lines 276 may be termed the primary guide. As discussed, the primary guide may be used to dampen the side-to-side swings of the derrick cable 204. In various embodiments, the dampening effect of the guide 208 (referred to herein as primary guide 208) may be insufficient, thereby requiring one or more secondary guides.

Figure 4:
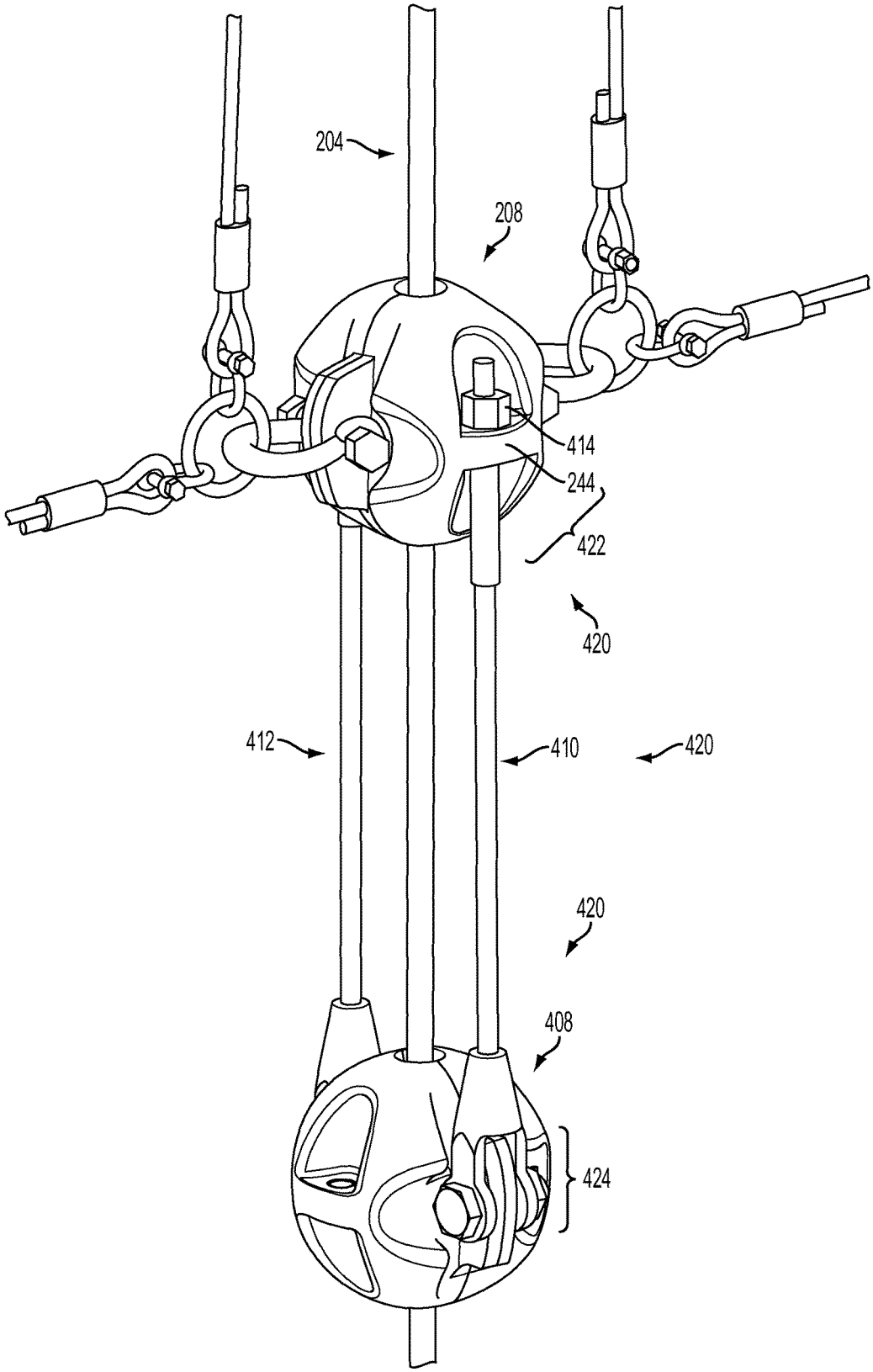
FIG. 4 is a perspective view of the stabilizer of FIG. 2 together with a secondary guide, according to one or more embodiments of the present disclosure.

A secondary guide may be configured to attach to a primary guide, thereby furthering the dampening effect on the derrick cable. Referring to FIG. 4, the secondary guide 408, like the primary guide 208, may be configured around the derrick cable 204, such that the derrick cable 204 may pass freely through the secondary guide 408. In various embodiments, the secondary guide 408 may hang underneath the primary guide 208. It is understood that the secondary guide 408 may be configured above, below, lateral to, or any other suitable configuration to the primary guide 208. The secondary guide 408 may be mechanically connected to the primary guide 208 using a secondary stabilizer assembly 420. The secondary stabilizer assembly 420 may comprise, but is not limited to, a primary guide securing mechanism 422, secondary guide cables or rods 410, 412, and a secondary guide securing mechanism 424.

The primary guide securing mechanism 422 may be configured to mechanically connect a secondary guide cable 410, 412 to the primary guide 208. One or more secondary guide cables or rods 410, 412 may be attached to the primary guide 208. For example, the secondary guide cable 410 may be partially inserted through the hang line assembly eyelet 244. In one embodiment, the secondary guide cable 410 may have a thread configured to allow a nut 414 to be screwed onto the secondary guide cable 410. It is understood that any method of mechanically connecting the secondary guide cable 410 to the primary guide 208 may be used.

Figure 4A:
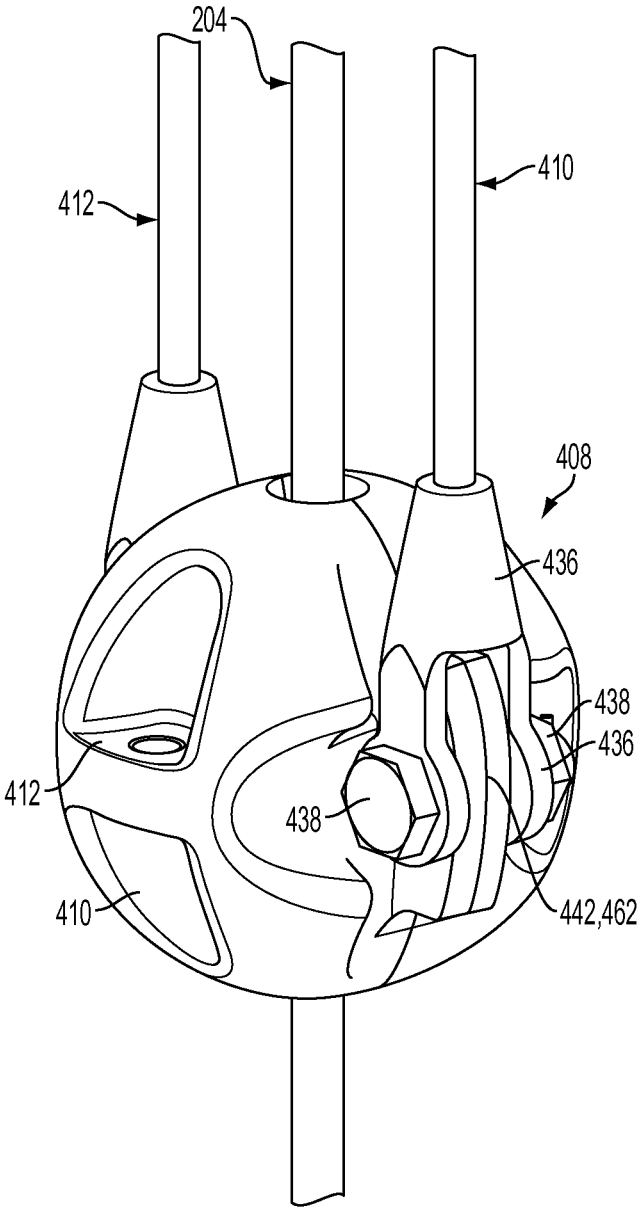
FIG. 4A is a close-up view of the secondary guide of FIG. 4.

The secondary guide 408 may be substantially similar to or the same as the primary guide 208. As seen in FIG. 4A, the secondary guide 408 may have a guide jacket 410 and a fortifying bracket 412. The guide jacket 410 may have a jacket securing eyelet 442 that substantially aligns with the bracket securing eyelet 462.

The secondary guide securing mechanism 424 may be configured to mechanically connect a secondary guide cable or rod 410, 412 to the secondary guide 408. One or more secondary guide cables or rods 410, 412 may be attached to the secondary guide 408. A secondary guide cable attachment 436 may be mechanically connected to the secondary guide 408 using a bolt 438, which may be threaded through the securing eyelets 442, 462. The secondary guide cable attachment 436 may house one end of the secondary guide cable 410. For example, the secondary guide cable 410 may be screwed into the secondary guide cable attachment 436. It is understood that any method of mechanically connecting the secondary guide cable 410 to the secondary guide 408 may be used.

The secondary guide cables or rods 410, 412 may be configured to allow some rotation of the secondary guide 408 relative to the primary guide 208. The secondary guide cables 410, 412 may be substantially rigid, in some embodiments. In various embodiments, the rotation may be limited to a maximum of approximately ninety degrees, thereby preventing the secondary guide cables 410, 412 from wrapping around the main derrick cable 204. In other embodiments, the rotation may be limited to a maximum of more or less than ninety degrees. The secondary guide cables 410, 412 may be comprised of steel rods, shafts, or tubes, or other materials such as wire rope. It is understood that any suitable material, or combination of materials, may be used.

It should be appreciated that by hanging a secondary guide below the primary guide, the need for additional hang lines and triangle lines to accommodate a secondary guide may be omitted. As such, additional cable and rigging assemblies may be avoided thereby further assisting in lessening the amount of drops that may occur on a project.

Figure 5:
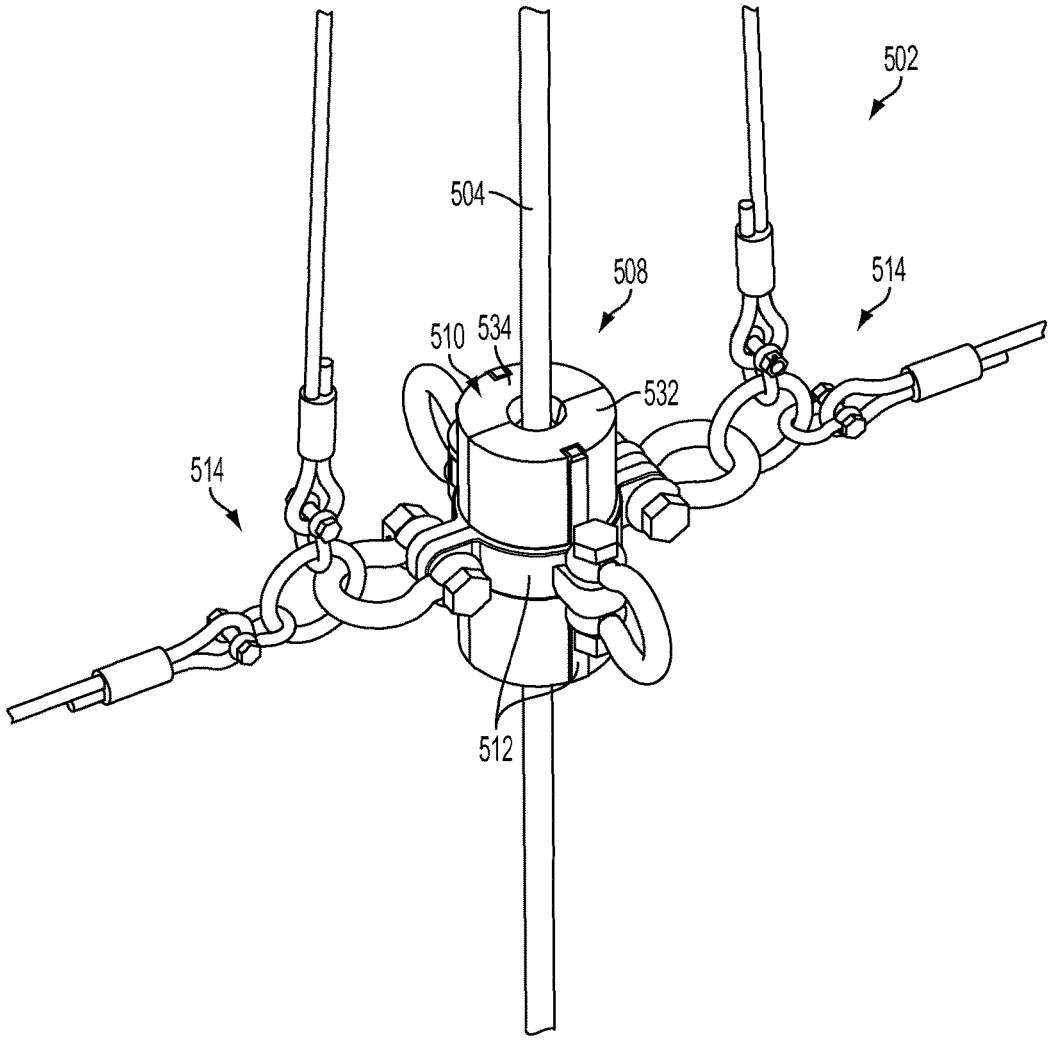
FIG. 5 is a perspective view of a stabilizer, according to one or more embodiments of the present disclosure.
Figure 5A:
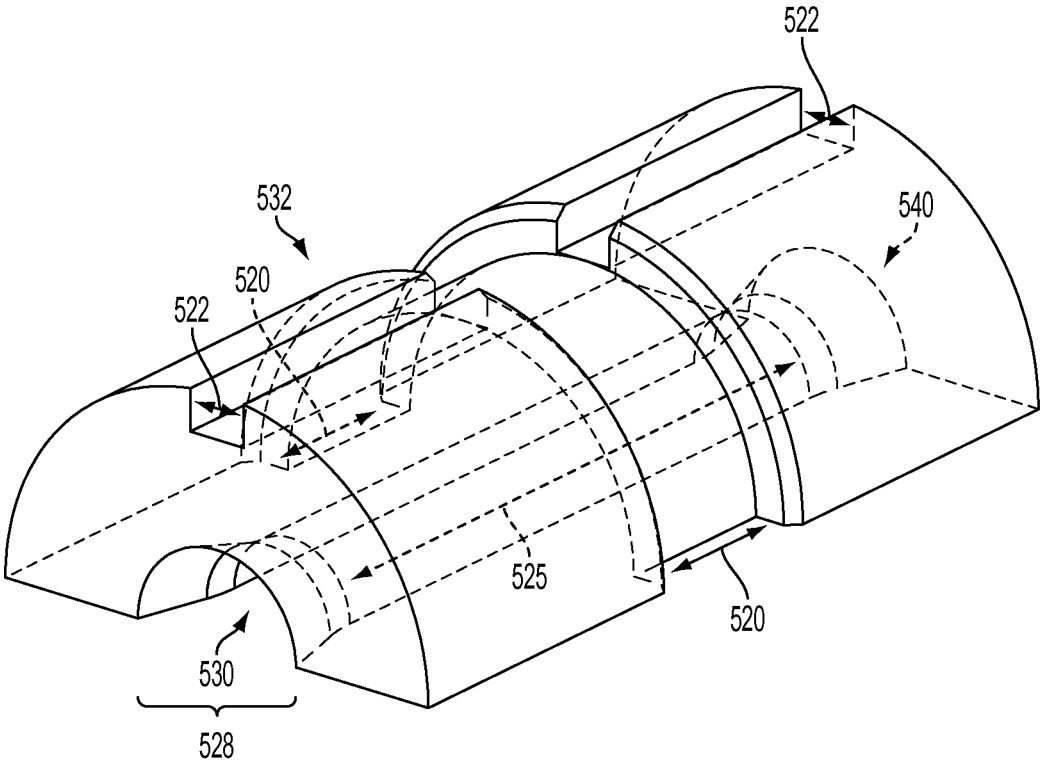
FIG. 5A is a perspective view of a guide jacket component of the stabilizer of FIG. 5.
Figure 5B:
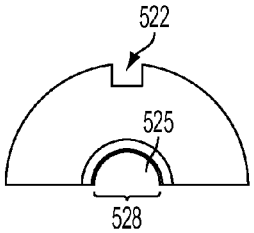
FIG. 5B is a top view of the guide jacket component of FIG. 5A.
Figure 5C:
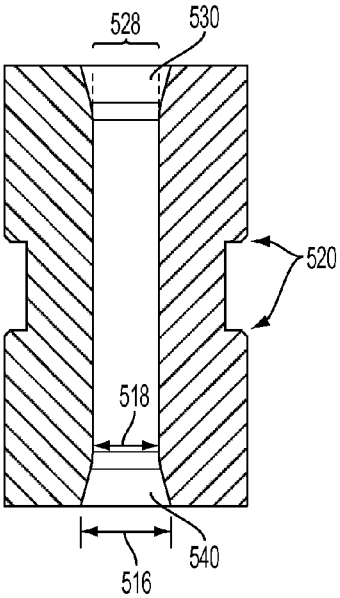
FIG. 5C is an inside view of the guide jacket component of FIG. 5A.
Figure 5D:
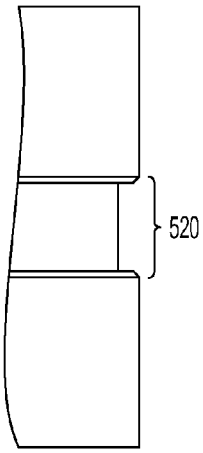
FIG. 5D is a side view of the guide jacket component of FIG. 5A.
Figure 5E:
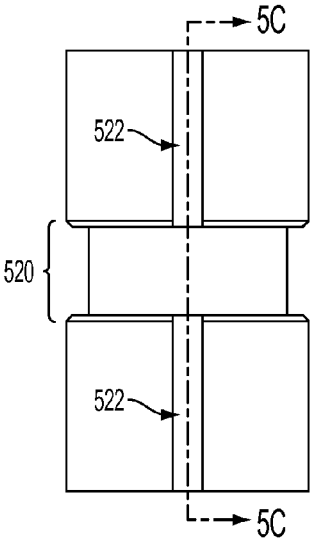
FIG. 5E is an outside view of the guide jacket component of FIG. 5A.
Figure 5F:
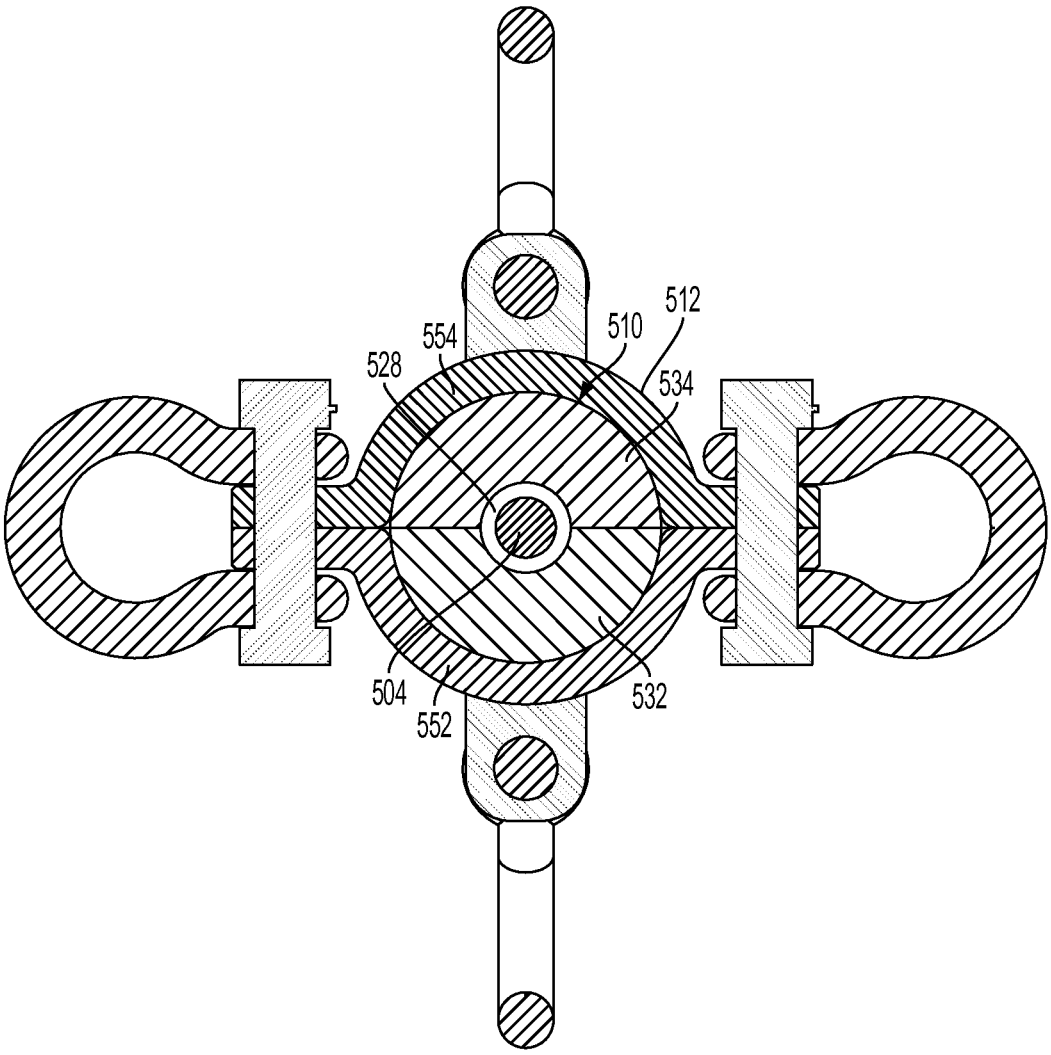
FIG. 5F is a cross-sectional view of the guide of the stabilizer of FIG. 5.
Figure 5G:
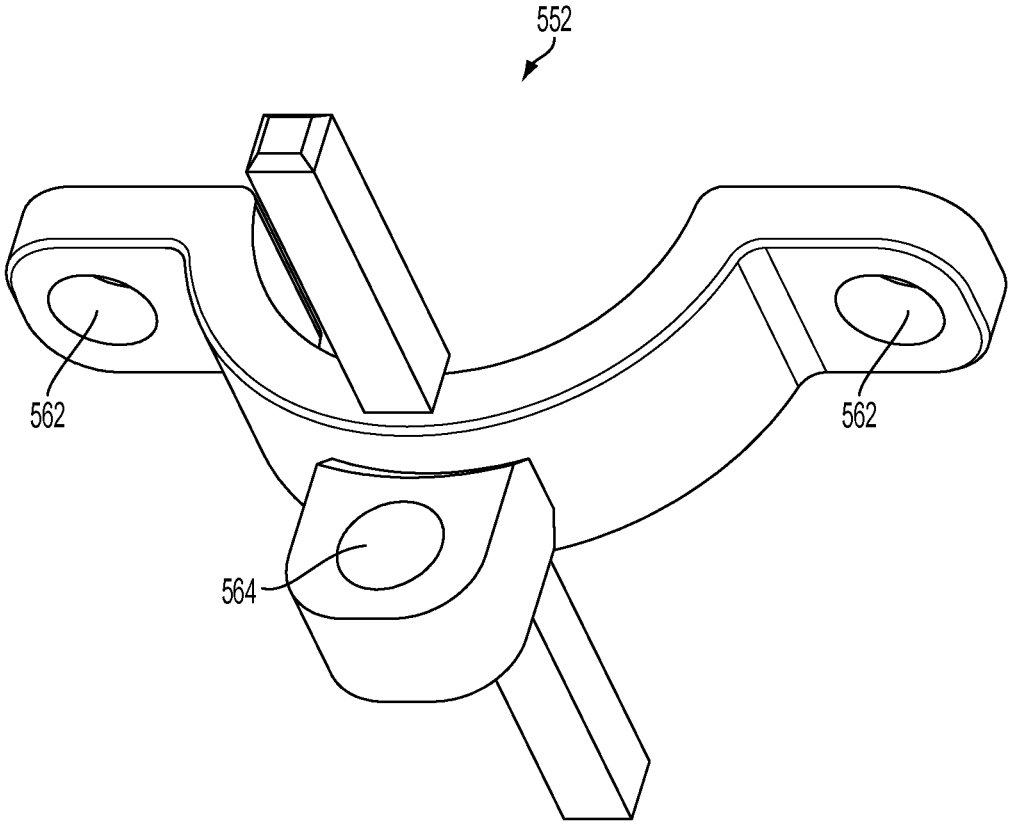
FIG. 5G is a perspective view of a fortifying bracket component of the guide of FIG. 5F.
Figure 5H:
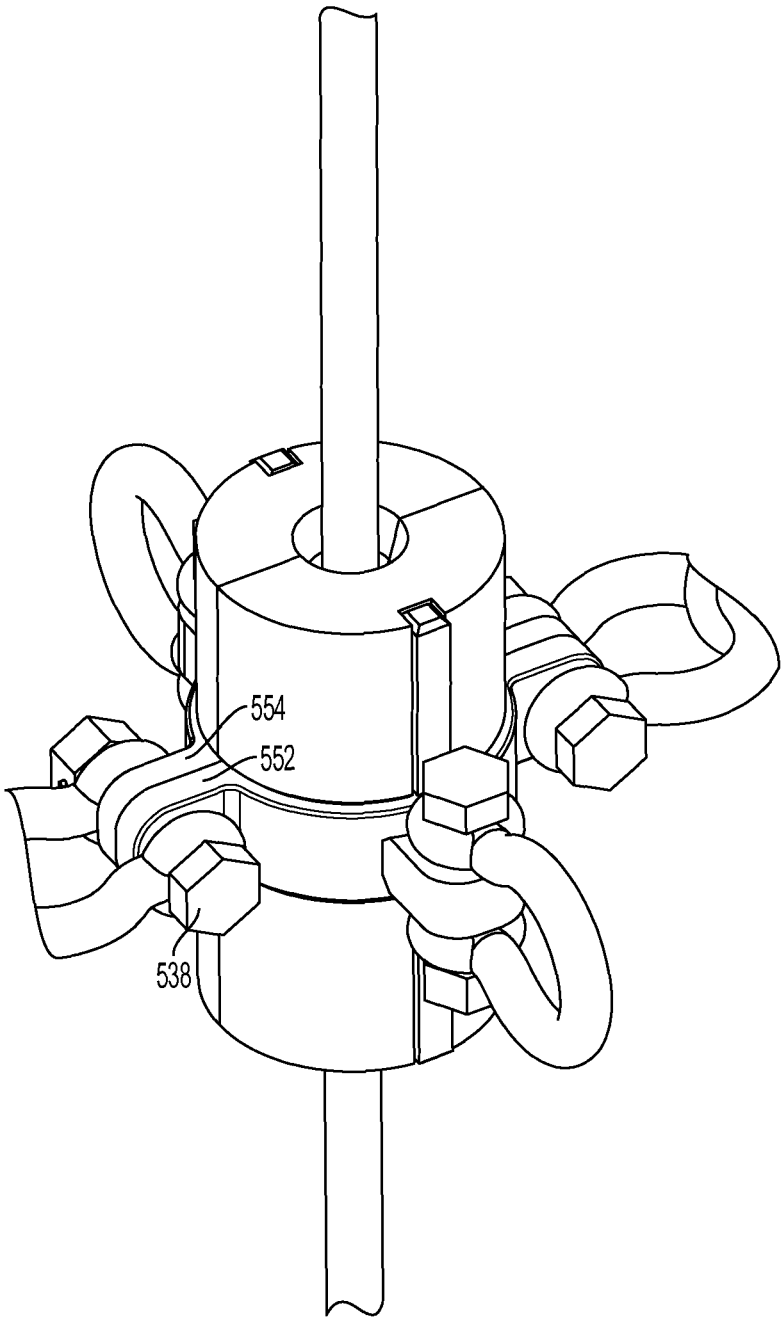
FIG. 5H is a perspective view of a fortifying bracket of the guide of FIG. 5F.

Turning now to FIGS. 5-5H, another embodiment of a fast line stabilizer is shown. In this embodiment, the line stabilizer 502 may generally be comprised of a guide 508 and a hang line assembly 514. In various embodiments, the fast line stabilizer may also include a secondary stabilizer and secondary stabilizer assembly.

Generally, as seen in FIG. 5, the guide 508 may be configured around the fast line 504, such that the fast line 504 may pass freely through a static-type guide 508 which avoids the use of rollers and other moving parts that could be dropped or otherwise thrown from the device during use. The guide 508 may be comprised of a guide jacket 510 and a fortifying bracket 512.

The guide jacket may generally be configured around the fast line, thus providing the guidance and dampening effects. The guide jacket may be comprised of one or more jacket components. As illustrated in FIG. 5, the guide jacket 510 may be comprised of two jacket components 532, 534. In other embodiments, the guide jacket 514 may be comprised of any number of jacket components. The jacket components may, generally, have a partial cylindrical form as seen in FIGS. 5A-E. The jacket component may have a top surface 524, a bottom surface 526, an inner surface 542 between the top surface 524 and the bottom surface 526, and an outer surface 544 between the top surface 524 and the bottom surface 544.

Referring to FIG. 5A, the top surface 524 may be substantially flat and semi-circular, in some embodiments. In other embodiments, the top surface 524 may be rounded, conical, or any other suitable shape. Similarly, the bottom surface 526 may be substantially flat and semi-circular, in some embodiments, or vary in shape, in other embodiments. The inner surface 542 may be substantially flat and rectangular. This may allow the inner surface of jacket component 532 to easily align with the inner surface of another jacket component. In other embodiments, there may be grooves, pockets, or protrusions on the inner surface 542 to facilitate proper alignment of the two or more jacket components. The outer surface 544 may generally be rounded, in some embodiments. When the inner surface 542 of the jacket components 532 and 534 align, they may form a rounded cylindrical shape having a flat top surface and a flat bottom surface and a longitudinal axis extending along the seam formed by the mating inner surfaces 542. It is understood that any shape, including but not limited to, a cube, cuboid, or sphere may be used.

The top surface 524 may have a partial opening 530. The bottom surface 526 may also have a partial opening 540. In various embodiments, the partial openings 530 and 540 may be circular. In other embodiments, alternative shapes may be used. When aligned with one or more other jacket components, the partial openings 530 and 540 may form a complete circle, or opening. Therefore, for purposes of this disclosure, the partial top opening may herein be referred to as the ingress opening 530 and the partial bottom opening may herein be referred to as the egress opening 540. It is understood that the fast line 504 may travel in any direction through the openings 530 and 540. The inner surface 542 may have a sleeve cut out 525 between the ingress opening 530 and the egress opening 540. When aligned, the sleeve cut out 525 of two jacket components may cooperate to form a sleeve 528. The sleeve may a substantially static components that allows the fast line 504 to pass through the guide 508.

The ingress opening 530 and egress opening 540 may narrow or taper from a relatively larger diameter 516 to a relatively smaller diameter 518 (as seen in FIG. 5C). In one embodiment, the relatively smaller diameter 518 may be the same diameter as the sleeve cut out 525, or sleeve 528. In other embodiments, the diameter of the ingress opening 530 or egress opening 540 may not taper.

The jacket component's outer surface 544 may have one or more fortifying bracket grooves. In one embodiment, the fortifying bracket grooves may include, but are not limited to, a longitudinal bracket groove 520 and a latitudinal bracket groove 522. One or more longitudinal bracket grooves 520 may encircle the external circumference of the jacket component 532. One or more latitudinal bracket grooves 522 may traverse the length of the jacket component 532. In various embodiments, the latitudinal bracket groove may substantially traverse the entire length of the jacket component 532. In other embodiments, the latitudinal bracket groove may traverse less than the entire length of the jacket component 532. In still other embodiments, there may be no latitudinal bracket groove.

The guide jacket, and its corresponding jacket components, may be made from one or more materials, including but not limited to, a durable and wear resistant plastic. It is understood that any suitable material, or combination of materials, may be used. As discussed above, a wear mark or wear groove may be used to indicate the amount of wear the guide 508 has experienced and when the guide jacket 510 or jacket components 532, 534 should be replaced. A wear mark may be placed laterally to the ingress opening 530 and/or the egress opening 540. In one embodiment, the wear mark may be a circular mark placed lateral to the ingress opening 530, where the wear mark has a radius one inch larger than the radius of the ingress opening 530. The opening 530 may slowly expand in diameter as the fast line 504 slowly causes the guide jacket 510 to wear. When the opening 530 has the same diameter as the wear mark, it may indicate the guide jacket 510 should be replaced. In another embodiment, a wear mark may be one or more lined grooves that flare out from the center of the ingress opening 530. As the fast line 504 wears away the guide jacket 510, the opening 530 may expand in diameter. When the opening 530 substantially eliminates all or a portion of the wear mark groove it may indicate a desired replacement of the guide jacket 510. In some embodiments, multiple wear marks or grooves may be provided such that the degree of wear may be monitored. That is, when a first wear mark is reached, an operator may understand how much of the life of the guide has been used and how much of the life remains.

In various embodiments, the sleeve 528 walls may be comprised of the wear resistant plastic, however, the walls of the sleeve may not notice the same wear as other parts of the guide 508. As can be appreciated by one skilled in the art, the most rapid wear may occur at the openings 530 and 540, and thus the wear indicator, or wear mark, may be located lateral to the openings 530 and 540. However, due to the flared opening at the top and bottom of the guide, the walls of the sleeve 528 may experience wear more readily depending on a variety of factors. It should be understood that a wear mark may be located in any suitable location. It should be further understood that the walls of the sleeve 528 may be comprised of any suitable material.

As seen in FIG. 5F, the jacket components 532 and 534 may be mechanically connected using the fortifying bracket 512. The fortifying bracket 512 may secure the guide jacket 510 around the fast line 504, whereby the fast line 504 may slide through the sleeve 528.

The fortifying bracket 512 may generally be configured around the guide jacket. That is, unlike the bracket 212 of the embodiment of FIGS. 2-2E, the fortifying bracket 512 may be positioned on an outside surface of the jacket so as to contain the jacket 510 within the bracket 512. The fortifying bracket 512 may be configured to allow the guide to withstand the pulling forces initiated by the fast line as it slams sideways in all directions. Like the bracket 212, the fortifying bracket 512 of the present embodiment may include one or more bracket components. As illustrated in the cross sectional view of FIG. 5F, the fortifying bracket 512 may be comprised of two bracket components 552, 554. In other embodiments, the fortifying bracket 212 may be comprised of any number of bracket components. The bracket components 552 and 554 may be generally aligned around the guide jacket 510, such that they secure the guide jacket components 532 and 534 together.

The bracket components 552 and 554 may be mirror images of each other, in some embodiments. In other embodiments, the bracket components may be comprised of varying shapes. As seen in the embodiment of FIG. 5G, the bracket component 552 may be comprised of a latitudinal arm 572, a longitudinal arm 570, an eyelet finger 576 at each end of the longitudinal arm 570, and an eyelet thumb 574 on the longitudinal arm 570.

The latitudinal arm 572 may generally cooperate with the latitudinal bracket groove 522, such that the latitudinal arm 572 may be at least partially inserted and/or nested into the latitudinal bracket groove 522. In various embodiments, the latitudinal arm 572 may be substantially similar in length, width, and height as that of the latitudinal bracket groove 522. In other embodiments, the latitudinal arm 572 may be longer or shorter than groove 522.

The longitudinal arm 570 may generally cooperate with the longitudinal bracket groove 520, such that the longitudinal arm 570 may be at least partially inserted into and/or nested in the longitudinal bracket groove 520. In various embodiments, the longitudinal arm 570 may be substantially similar in length, width, and height as that of the longitudinal bracket groove 520. In some embodiments, the longitudinal bracket groove may have the same curve or arc as the outer surface 544 of the jacket component 532. In other embodiments, such as where the jacket component is a cube, the longitudinal bracket arm may have one or more right angles. The groove 520 and the arm 570 may be arranged at approximately the mid-height of the guide such that the bracket may impart substantially uniform retention pressure on the guide jacket.

The lateral end of the longitudinal arm 570 may angle, thereby forming an eyelet finger 576. The eyelet finger 576 may have an eyelet 562. The eyelet, or bracket securing eyelet 562 may be configured to mechanically connect the bracket component 552 to another bracket component using a securing mechanism. As seen in FIG. 5H, the bracket component 552 may be generally aligned with bracket component 554, such that the bracket securing eyelets align. The bracket component 552 may be mechanically connected to bracket component 554 using a bolt 538.

Referring back to FIG. 5G, an eyelet thumb 574 may protrude from the longitudinal arm 570. The eyelet thumb 574 may have an eyelet 564. The eyelet, or hang line assembly eyelet 564, may be used, in part, to mechanically connect one or more components. In some embodiments, the hang line assembly eyelet 564 may or may not be used to attach the hang line assembly, a secondary guide, or both.

The fortifying bracket, and its corresponding bracket components, may be made from one or more materials, including but not limited to, maraging steel, stainless steel, steel iron-nickel, Inconel, tool steel, nickel, iron, titanium, any other suitable metal or metal alloy, or any combination thereof. It is understood that any suitable material, or combination of materials, may be used.

The guide 508 may be connected to the platform 100 using a hang line assembly 514, as discussed above. A secondary guide may also be attached to the guide 508 in a substantially similar way to that previously disclosed.

Figure 6:
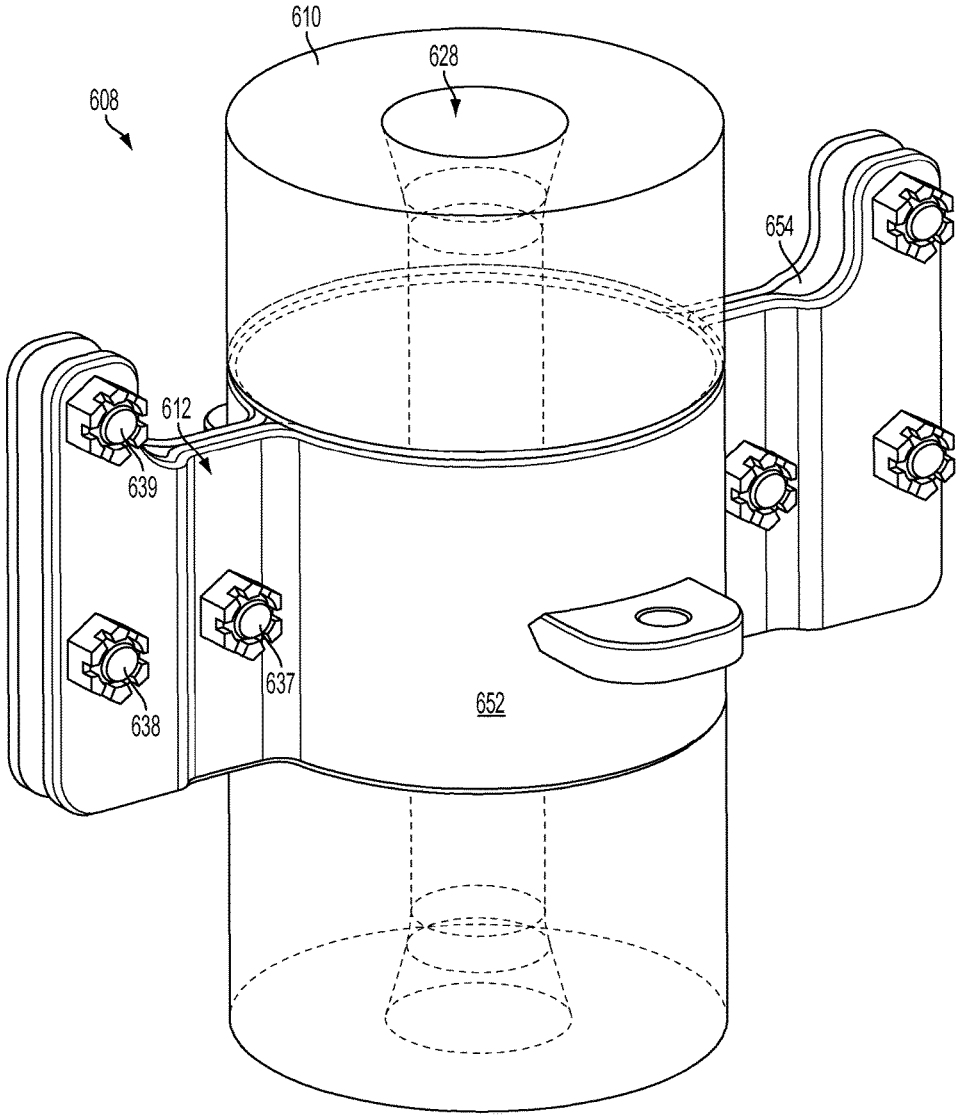
FIG. 6 is a perspective view of a guide portion of a stabilizer, according to one or more embodiments.
Figure 6A:
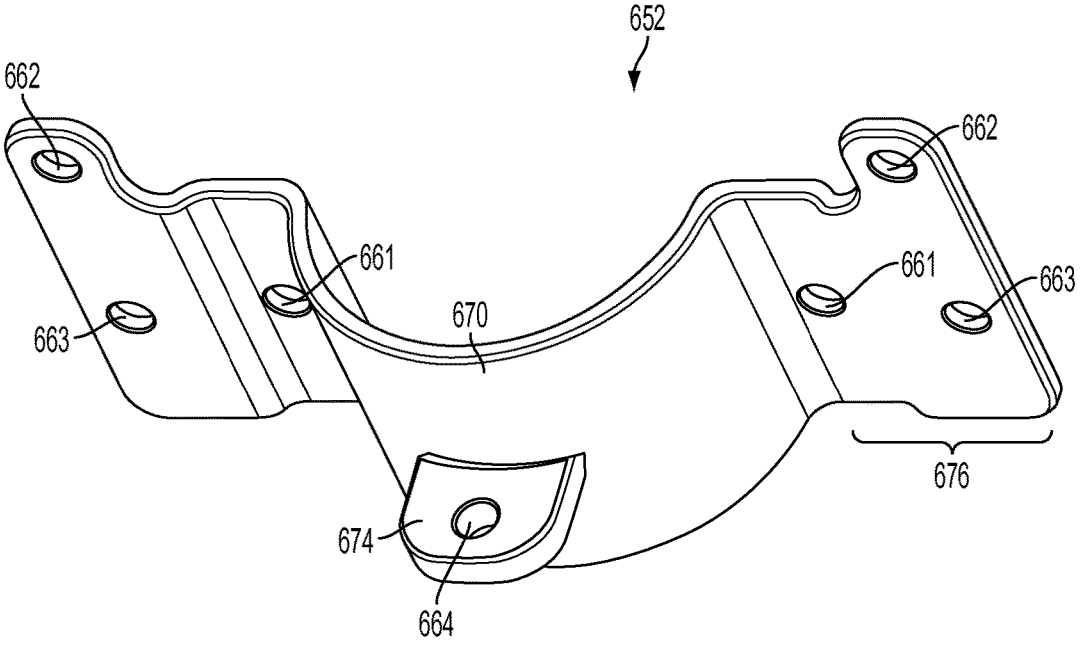
FIG. 6A is perspective view of a fortifying bracket of the guide of FIG. 6.
Figure 6B:
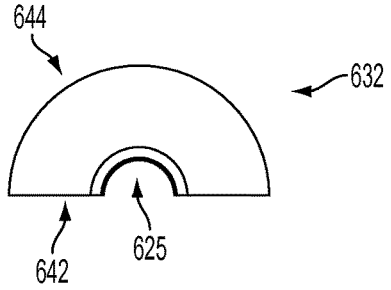
FIG. 6B is a top view of a guide jacket component of the guide of FIG. 6.

Turning now to FIGS. 6-6B, yet another embodiment of a fast line stabilizer may be provided. As with the previous embodiments, the fast line stabilizer may include a guide 608 and a hang line assembly. Still further, as with the other embodiments, a substantially static sleeve-type guide may be provided that reduces the number of parts previously used in these types of guides and, thus, reduces the chances of dropped or thrown objects. In various embodiments, the fast line stabilizer may also include a secondary stabilizer and secondary stabilizer assembly.

Generally, as seen in FIG. 6, the guide 608 may be configured to have an inner lumen 628, such that the whip line may pass freely through the guide 608. The guide 608 may be comprised of a guide jacket 610 and a fortifying bracket 612.

The guide jacket 610 may generally be configured around the whip line, thus providing the guidance and dampening effects. The guide jacket may be comprised of one or more jacket components. In one embodiment, the guide jacket may be comprised of one jacket component where the jacket component is a single mold. In another embodiment, two jacket components may be aligned to comprise the guide jacket 610. The guide jacket 610 may be comprised of any number of jacket components. The jacket components may, generally, have a cylindrical form, or half of a cylinder, as seen in FIGS. 6A-E. However, it is understood that any shape may be used. The jacket component 632 may have a top surface 624, a bottom surface 626, an inner surface 642 between the top surface 624 and the bottom surface 626, and an outer surface 644 between the top surface 624 and the bottom surface 626.

Referring to FIG. 6B-E, the top surface 624 may be substantially flat and generally circularly shaped. In other embodiments, the top surface 624 may be rounded, conical, or any other suitable shape. Similarly, the bottom surface 626 may be substantially flat and circular in shape, or it may vary in shape. The inner surface 642 may be substantially flat and may be substantially rectangular. This may allow the inner surface 642 of jacket component 632 to easily align with the inner surface of another jacket component. In other embodiments, there may be grooves, pockets, or protrusions on the inner surface 642 to facilitate proper alignment of the two or more jacket components. The outer surface 644 may generally be rounded, in some embodiments. When the inner surface 642 of two jacket components align, they may form a rounded cylindrical shape having a flat top surface and a flat bottom surface with a longitudinal axis extending along the seam formed by the contacting inner surfaces. It is understood that any shape, including but not limited to, a cube, cuboid, or sphere may be used.

The top surface 624 may have a partial opening 630. The bottom surface 626 may also have a partial opening 640. In various embodiments, the partial openings 630 and 640 may be circular. In other embodiments, alternative shapes may be used. When aligned with one or more other jacket components, the partial openings 630 and 640 may form a complete circle, or opening. Therefore, for purposes of this disclosure, the partial top opening may herein be referred to as the ingress opening 630 and the partial bottom opening may herein be referred to as the egress opening 640. It is understood that the whip line may travel in any direction through the openings 630 and 640. The inner surface 642 may have a sleeve cut out 625 between the ingress opening 530 and the egress opening 640. When aligned, the sleeve cut out 625 of a plurality of jacket components may cooperate to form a substantially static sleeve, or lumen 628. The static lumen 628 may allow the whip line to pass through the guide 608 without encountering obstructions or otherwise having catch points.

Figure 6C:
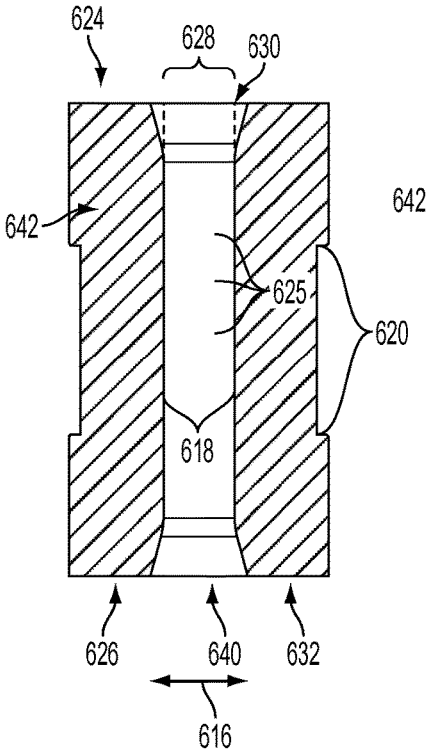
FIG. 6C is an inside view of the guide jacket of FIG. 6B.
Figure 6D:
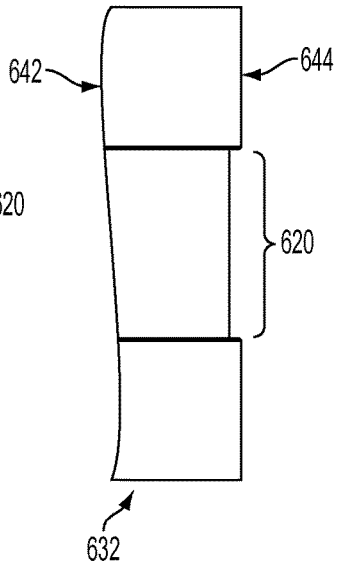
FIG. 6D is a side view of the guide jacket of FIG. 6B.
Figure 6E:
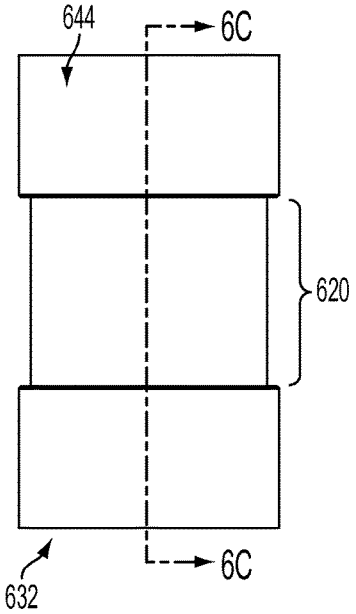
FIG. 6E is an outside view of the guide jacket of FIG. 6B.
Figure 7:
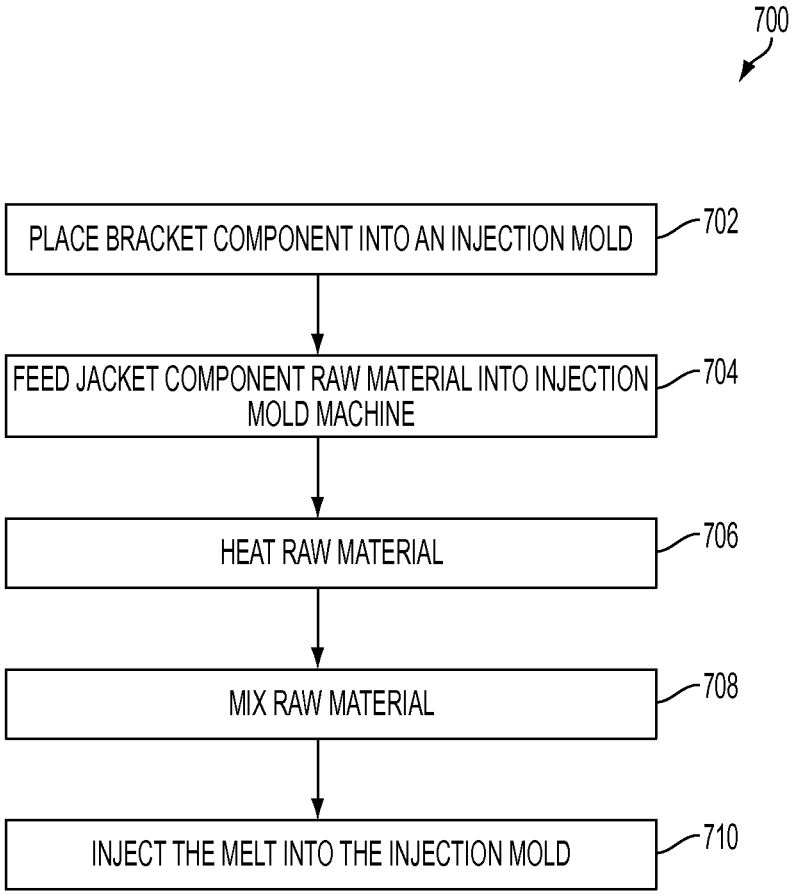
FIG. 7 is an operational diagram depicting several operations performed to make a stabilizer or guide thereof, according to one or more embodiments.

The ingress opening 630 and egress opening 640 may narrow or taper from a relatively larger diameter 616 to a relatively smaller diameter 618 (as seen in FIG. 6C). In one embodiment, the relatively smaller diameter 618 may be the same diameter as the sleeve cut out 625, or lumen 628. In other embodiments, the diameter of the ingress opening 630 or egress opening 640 may not taper.

The jacket component's outer surface 644 may have one or more fortifying bracket grooves. In one embodiment, the fortifying bracket groove may include, but is not limited to, a longitudinal bracket groove 620. One or more longitudinal bracket grooves 620 may encircle the external circumference of the jacket component 632.

The guide jacket, and its corresponding jacket components, may be made from one or more materials, including but not limited to, a durable and wear resistant plastic. It is understood that any suitable material, or combination of materials, may be used. As discussed above, a wear mark or wear groove may be used to indicate the amount of wear the guide 608 has experienced and when the guide jacket or jacket components should be replaced. A wear mark may be placed laterally to the ingress opening 630 and/or the egress opening 640. In one embodiment, the wear mark may be a circular mark placed lateral to the ingress opening 630, where the wear mark has a radius one inch larger than the radius of the ingress opening 630. The opening 630 may slowly expand in diameter as the whip line slowly causes the guide jacket 610 to wear. When the opening 630 has the same diameter as the wear mark, it may indicate the guide jacket 610 should be replaced. In another embodiment, a wear mark may be one or more lined grooves that flare out from the center of the ingress opening 630. As the whip line wears the guide jacket 610, the opening 630 may expand in diameter. When the opening 630 substantially eliminates the wear mark groove it may indicate a desired replacement of the guide jacket 610.

In various embodiments, the lumen 628 walls may be comprised of the wear resistant plastic, however, the walls of the sleeve may not notice the same wear as other parts of the guide 608. As can be appreciated by one skilled in the art, the most rapid wear is most likely to occur at the openings 630 and 640, and thus the wear indicator, or wear mark, may be located lateral to the openings 630 and 640. It should be understood that a wear mark may be located in any suitable location. It should be further understood that the walls of the sleeve 628 may be comprised of any suitable material.

As seen in FIG. 6A, the guide jacket 610 may be substantially encircled by the fortifying bracket 612. The fortifying bracket 612 may secure the guide jacket 610 around the whip line, whereby the whip line may slide through the lumen 628.

The Fortifying Bracket may generally be configured around the guide jacket. The fortifying bracket may be configured to allow the guide to withstand the pulling forces initiated by the fast line as it slams sideways in all directions. The fortifying bracket may be comprised of one or more bracket components. In other embodiments, the fortifying bracket may be comprised of any number of bracket components. The bracket components may be generally aligned around the guide jacket.

As seen in the embodiment of FIG. 6F, the bracket component 652 may be comprised of a longitudinal arm 670, an eyelet finger 676 at each end of the longitudinal arm 670, and an eyelet thumb 674 on the longitudinal arm 670.

The longitudinal arm 670 may generally cooperate with the longitudinal bracket groove 620, such that the longitudinal arm 670 may be at least partially inserted and/or nested into the longitudinal bracket groove 620. In various embodiments, the longitudinal arm 670 may be substantially similar in length, width, and height as that of the longitudinal bracket groove 620. In some embodiments, the longitudinal bracket groove 620 may have the same curve or arc as the outer surface 644 of the jacket component 632. In other embodiments, such as where the jacket component is a cube, the longitudinal bracket arm may have one or more right angles. In comparison to the embodiment shown in of FIG. 5G, the longitudinal arm may be relatively thin and plate-like and may extend further (upward and downward) along the outer surface of the guide jacket.

The lateral end of the longitudinal arm 670 may comprise one or more bevels or angles, thereby forming an eyelet finger 676. The eyelet finger 676 may have one or more eyelets 661, 662, and 663. The eyelets, or bracket securing eyelets 661, 662, and 663 may be used, in part, to mechanically connect the bracket component 652 to another bracket component. As seen in FIG. 6A, the bracket component 652 may be generally aligned with bracket component 654, such that the bracket securing eyelets align. The bracket component 652 may be mechanically connected to bracket component 654 using one or more bolts 637, 638, 639.

Referring back to FIG. 6F, an eyelet thumb 674 may protrude from the longitudinal arm 670. The eyelet thumb 574 may have an eyelet 664. The eyelet, or hang line assembly eyelet 664, may be used, in part, to mechanically connect one or more components. In some embodiments, the hang line assembly eyelet 664 may or may not be used to attach the hang line assembly, a secondary guide, or both.

The fortifying bracket 612, and its corresponding bracket components 652 and 654, may be made from one or more materials, including but not limited to, maraging steel, stainless steel, steel iron-nickel, Inconel, tool steel, nickel, iron, titanium, any other suitable metal or metal alloy, or any combination thereof. It is understood that any suitable material, or combination of materials, may be used.

The guide 508 may be connected to the platform 100 using a hang line assembly 514, as discussed above. A secondary guide may also be attached to the guide 508 in a substantially similar way to that previously disclosed.

Figure 9:
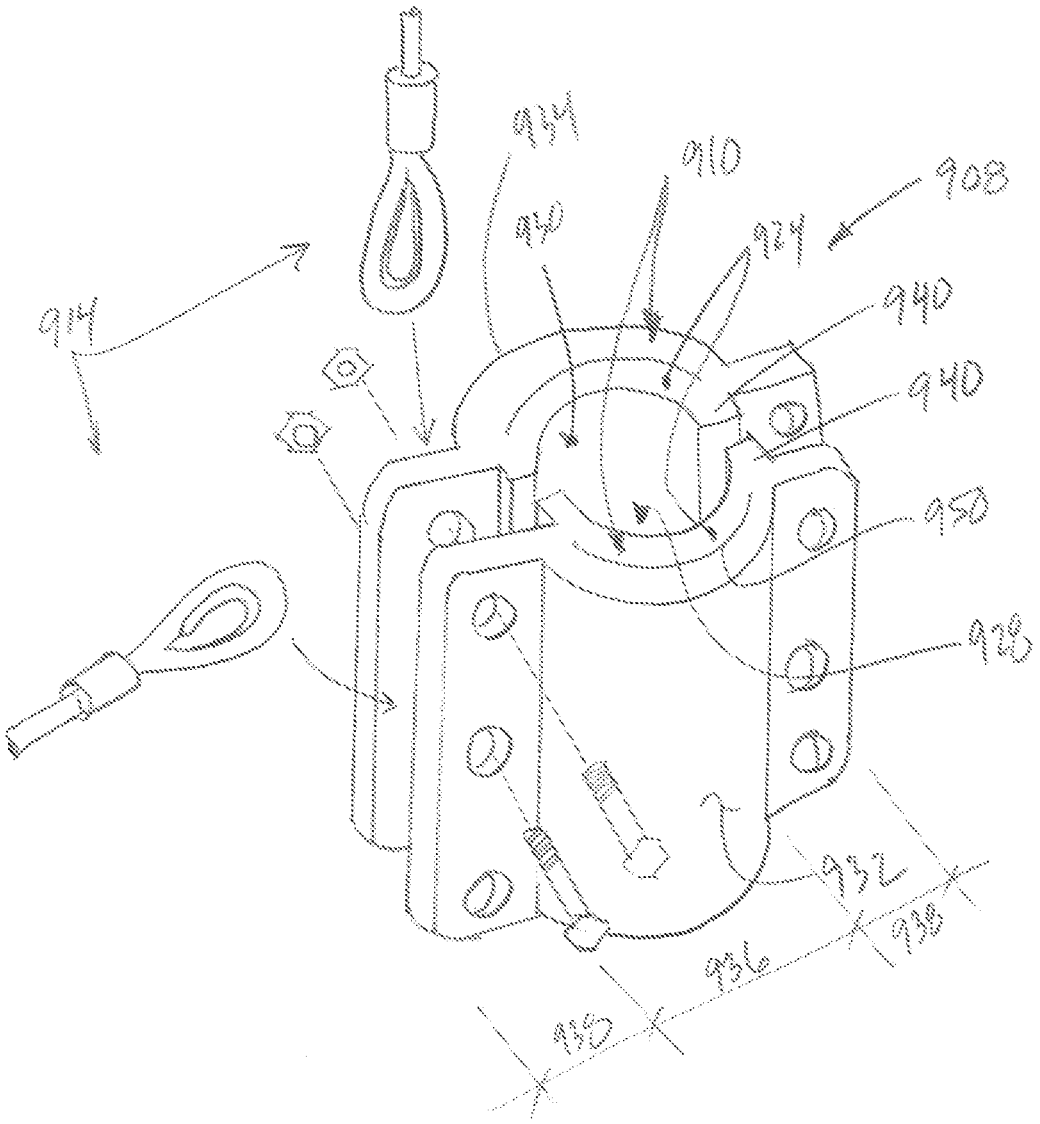
FIG. 9 is a perspective view of a guide portion of a stabilizer, according to one or more embodiments.

Referring ahead to FIG. 9, yet another embodiment of a guide 908 is shown. In the present embodiment, the guide 908 may include a guide jacket 910 constructed from a relatively strong material such as steel, alloy, or other material with a relatively high modulus of elasticity. With a higher modulus of elasticity as compared to many plastics or rubbers, for example, the guide jacket 910 may have a capacity to withstand the tensile and other deformation forces imparted on the guide 908 due to the waving and whipping of the wireline in conjunction with a hanger assembly 914 which is configured to generally maintain the position of the guide 908. In light of this ability to withstand these tensile and other deformation forces, the fortifying bracket shown in other embodiments may be omitted thereby further reducing the number of parts and reducing the chances of dropped or thrown parts. It is noted that the present embodiment also uses a unique method for securing the guide to the hangline assembly such that fewer parts are needed and still fewer parts are available to be dropped or thrown from the device. It is to be appreciated that a fortifying bracket may still be included to reinforce the guide jacket 910. In the present embodiment, a guide 908 is shown together with a portion of a hanger assembly 914.

The guide jacket 910 of the present embodiment may be similar in several ways to the guide jacket of the embodiments shown in FIGS. 2-6E. That is, the guide jacket 910 may include a top surface 924 may have an opening 930. The bottom surface may also have an opening. In various embodiments, the openings may be circular. In other embodiments, alternative shapes may be used. When aligned, one or more jacket components may form the guide jacket 910 and, thus, the openings may be formed from semicircular halves on each guide jacket, for example. For purposes of this disclosure, the top opening may herein be referred to as the ingress opening 930 and the bottom opening may herein be referred to as the egress opening. However, it is to be appreciated that the fast line may travel in any direction through the openings. The inner surface may have a sleeve cut out between the ingress opening 930 and the egress opening 940. When aligned, the sleeve cut out of two jacket components may cooperate to form a sleeve 928. The sleeve may allow the fast line to pass through the guide 908.

The ingress opening 930 and egress opening may narrow or taper from a relatively larger diameter to a relatively smaller diameter (comparable or the same as that seen in FIG. 5C, for example). In one embodiment, the relatively smaller diameter may be the same diameter as the sleeve cut out, or sleeve 928. In other embodiments, the diameter of the ingress opening 930 or egress opening may not taper. As with the other embodiments herein, the present embodiment may also include a wear mark 950 arranged radially outward from the openings on the top and bottom and usable to determine the amount of wear on the guide 908.

The guide 908 may include a guide jacket 910 made from two guide jacket components 932, 934 forming each half of the guide jacket 910. It is to be appreciated that the guide jacket 910 may also include fewer or more components to form the whole guide jacket. The guide jacket components 932, 934 may be secured to one another to form a guide jacket that may be secured around a fastline or wireline, for example.

The guide jacket components 932, 934 of the present embodiment may include a molded, forged, or machined element that forms a portion of the guide jacket 910. As shown, the guide jacket component 932, 934 may include a central body portion 936, a pair of flange portions 938, and a pair of separating standoffs 940.

The central body portion 936 may form the main portion of the guide jacket component 932, 934. The central body portion 936 of the component may have an outside surface that is substantially cylindrical forming substantially half of an outer wall of a cylinder, for example. It is to be appreciated that while this embodiment is shown to have an outer surface being singly curved, a doubly curved surface (i.e., like the embodiment of FIGS. 2-4A) may be provided. The central body portion may include an inner surface defining a curved surface arranged substantially concentrically with the outer surface such that the central body portion 936 has a thickness that is substantially constant. In other embodiments, the outer and inner surfaces may not be concentrically arranged. The central body portion 936 may have a top portion and a bottom portion defining a length extending therebetween. The central body portion 936 may also include a pair of longitudinal edges extending generally parallel to the axis of the cylinder defined by the outer and/or inner surfaces.

The inner surface of the guide jacket may include a wear resistant liner or may include a hardened surface, for example. In the case of a wear resistant liner, a wear layer may be weld deposited onto the inner surface, for example, and then may be machined to provide a smooth inner surface for the wireline to pass along. In some embodiments, for example, the wear resistant liner may include a copper, nickel, and aluminum alloy that is weld deposited onto the inner surface and machined to a more uniform thickness and smooth surface. In some embodiments, for example, the inner surface of the body portion may have a curvature for a 2¾" diameter sleeve. A ¼" layer of wear material may be deposited onto the inner surface and that layer may be machined down to approximately a ⅛" thick layer of material providing for a 2½ inch diameter lined sleeve, for example. As mentioned, the ends of the sleeve may taper to a broader sleeve diameter as the ends of the guide are approached. In these cases, a substantially uniform layer of wear material may be deposited on this flared portion as well. In some embodiments, the thickness of the wear material may be increased as the ends of the jacket are approached, while maintaining the flared shape. In the case of a hardened surface, each of the jacket components may be fabricated from a steel or other metal material that is capable of heat treating. The jacket component or the surface of the jacket component may then be heat treated to create a hardened surface along which the wire line may run.

The guide jacket 910 may also include a pair of flanges 938 extending generally radially outwardly from each of the longitudinal edges of the central body portion 936. The flanges 938 may have a length measured along the axis of the cylinder that is substantially the same as the length of the central body portion 936. The flanges 938 may extend radially outward by a distance configured to accommodate attachment of each of the guide jacket components 932, 934 with bolts, for example. In some embodiments, for example, the flanges 938 may extend radially outward by a distance equal to twice the edge distance specified for a particular bolt size. In other embodiments, other flange widths may be provided. The flanges 938 may be configured for alignment with a corresponding flange on the other guide jacket component as shown in FIG. 9, for example. The flanges 938 may include one or more bolt holes for receiving a clamping bolt for holding the components together and the holes in one flange 938 may be located in substantially the same position as the bolt holes in the corresponding flange 938 such that the bolt may extend through each flange 938 when the guide jacket is assembled.

As mentioned, each guide jacket component may include a pair of separating standoffs 940. As shown, the standoffs 940 may be arranged to extend from the central body portion 936 substantially adjacent to the branch off point of the flange 938. The standoffs 940 may extend outward and may be arranged to align with a corresponding standoff 940 on the opposing jacket component and, as such, may define the space or gap that is provided between the above-described flanges 938. The standoffs 940 may extend approximately ½ of the distance used to accommodate the hanger assembly ropes such that when assembled, the space between the flanges 938 used for the hanger assembly ropes is fully provided by the two corresponding standoffs 940. In some embodiments, the amount of standoff 940 may be selected to accommodate a large number of rope sizes and, thus, may be selected to accommodate relatively large rope diameters. The standoffs 940 may extend the full length of the body portion or they may be provided intermittently or have a length less than the full length of the body.

In some embodiments the standoffs 940 may include a roughened, textured, or otherwise engaging surface to resist slippage of one standoff 940 relative to another. In still other embodiments, the standoffs 940 may be toothed, notched, or otherwise shaped to engage each other to resist relative vertical or horizontal movement. In some embodiments, such teeth, notches, or other shapes may be arranged or spaced along the length of the standoff 940 such that opposing jacket components remain identically shaped, but that when they are turned to face one another, the teeth, notches, or other shapes engage. For example, the standoff 940 on one side of the sleeve may have a particular tooth or notch pattern and the standoff on the same jacket component on the other side of the sleeve may have an opposite or registered pattern such that when one jacket component is turned against another, the standoffs engage one another.

In any case, as shown in FIG. 9, the wire ropes may be placed between the flanges 938 on the two jacket components 932, 934 and the jacket components 932, 934 may be bolted together by placing the bolts through the holes in the flanges 938 and also through the eyes on the hanger assembly ropes. In some embodiments, the vertically supporting hanger ropes of the hanger assembly may be secured to the bolts secured through the top holes in the flanges and the triangle ropes may be secured to the bolts through the middle holes. The bottom holes in the flanges may be available to secure a secondary guide to the wireline by suspending it below the guide shown, similar to that shown in FIG. 4, for example. It is to be appreciated that this approach eliminates yet another component from the system because a shackle is not used to connect the wire rope to the guide 910. In some embodiments, the bolt diameter may be selected to accommodate the rope diameter because rigging rules or regulations may define a particular eye size for a particular rope diameter and the thimble used in the eye may be configured for positioning around a particular shaft size. For example, the bolt selected to secure the jacket components may be similar to the pin size on a D-shackle that may otherwise be used to connect the wire rope such that kinking or bending of the thimble may be avoided.

The following discussion is directed to a method of making and a method of use for the fast line stabilizer shown in FIGS. 2-4A, for example. However, it is to be appreciated that the steps of using stabilizer shown in FIGS. 2-4A can be implemented using any number of different fast line stabilizer embodiments.

The fortifying bracket component 252 and guide jacket component 232 combination of the guide 208 may be constructed using a variety of fabrication techniques. In some embodiments, the bracket component may be constructed from a CuNiAl alloy and may be cast or otherwise formed. Other suitable materials may also be used for the bracket.

The guide jacket may be an injection molded component, for example, where a raw material, or resin, used to create the jacket component may be fed into the injection mold machine 704. In one embodiment, a durable and wear resistant plastic, such as PUR 72 shore D, may be fed into an injection mold machine. In other embodiments, the plastic may include, but is not limited to, Ertalyte Tex., Ertalyte, Techtron HPV PPS, Duratron T4301, Ketron PEEK-HPV, Orkot C329 TLG, Orkot TLM, Ertalon LFX, Delrin, Nylon, Vespel, Meldin, Acetron, Torlon, Turcite, Rulon, UHMW, Fluorosint 207, Tivar, any other suitable plastic, or any combination thereof. Other non-plastic materials may additionally or alternatively be used, including but not limited to, metals, alloys, rubbers, additives, colorants, or any other suitable material.

The injection mold machine may heat the raw materials 706. In various embodiments the raw materials may be heated until they become a melt. The melt may have viscous properties. The injection mold machine may also mix the raw materials, or melt 708. By mixing the materials, the end product material may be more uniform in consistency. It is understood that the heating 706 and/or mixing 708 of the raw material(s) may additionally or alternatively be performed prior to the raw material being fed into the injection mold machine 704.

The melt may be injected into the injection mold 710. The melt may be injected into the mold such that the melt fully encapsulates the bracket component. That is, the bracket component may be previously formed and placed in the mold to ready the mold for injection of the guide jacket material. The melt may fill, or substantially fill the mold. The finished mold may then be cooled. In various embodiments, the finished mold, or jacket component 232, may comprise the eyelets 242, 244 and wear mark 250. In other embodiments, the eyelets 242, 244 and/or wear mark 250 may alternatively be constructed after the mold has cooled. It is understood that in various embodiments, the fortifying bracket may be less than fully encapsulated. For example, the guide jacket 210 may or may not encase a portion of the securing or hang line eyelets.

The injection mold machine method may be used to create a mirror image of the jacket component 232 and bracket component 252 combination. By using the method to create the mirror image combination, jacket component 234 and bracket component 254, a user may have substantially created a completed guide 208.

It is to be appreciated the embodiments shown in FIGS. 5-5H and FIGS. 6-6E may be similarly formed. However, in these cases, the fortifying bracket may be isolated from the injection molding process and applied to the guide jacket after the guide jacket is removed from the mold. In other embodiments, however, the fortifying bracket may be included in the injection molding process even though it is arranged on an outside surface of the guide jacket.

Figure 8:
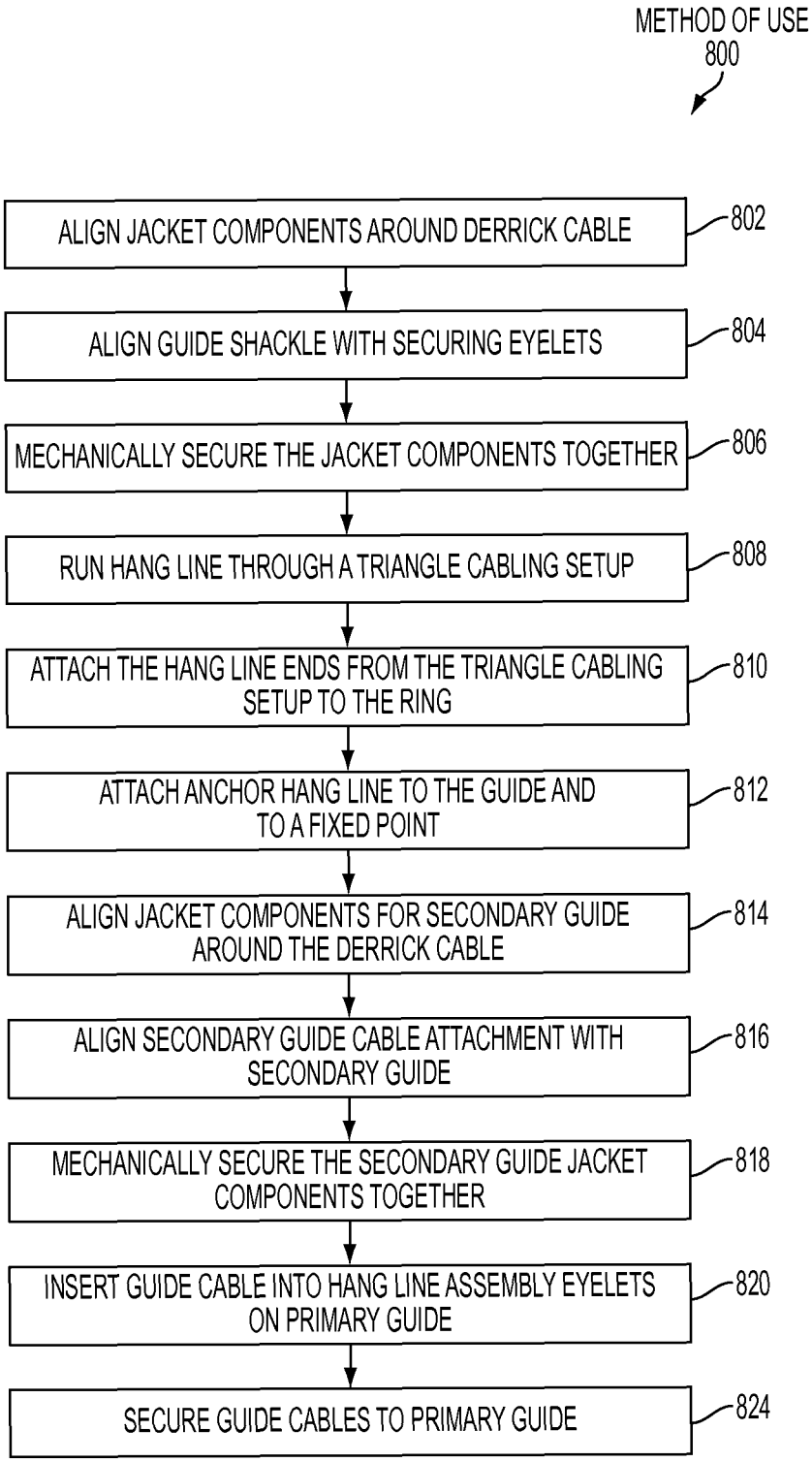
FIG. 8 is an operational diagram depicting several operations performed in using a stabilizer or guide thereof, according to one or more embodiments.

Once the jacket component 232 and bracket component 252 combination (herein referred as a guide half) have been created. A user, as demonstrated in FIG. 8, may use the stabilizer to dampen the effects of the derrick cable being spooled on and off a drum. In various embodiments, a user may align the jacket components 232, 234, or guide halves, around the derrick cable 204 such that their securing eyelets 242 substantially align 802.

In some embodiments, a guide shackle 236 may be aligned 804 with the securing eyelets 242. The eyelets of the shackle 236 may substantially align with the openings of the securing eyelets 242. In various embodiments, before the shackle 236 is aligned with the securing eyelets 242, a ring 266 may be thread onto the shackle 236. It is understood that in some embodiments a shackle 236 and/or a ring 266 may or may not be used.

The jacket components may be mechanically secured 806. In various embodiments, a bolt 238 may be thread through the one or more securing eyelets 242 of jacket components 232 and 234. The bolt may additionally be thread through the openings on the shackle 236, thereby mechanically connecting the shackle 236 to the guide 208. The bolt 238 may be fitted on each end with a securing mechanism. In various embodiments, the bolt may be fastened on one or both ends with a washer and/or nut. In another embodiment, the bolt may have a capped end and may be secured on the other end using a pin. It is understood that any method to secure the bolt may be used. In still another embodiment, the guide halves may be mechanically connected and secured using an industrial tape. It is understood that any method to mechanically connect and secure the two guide halves together may be used.

A hang line 268 may be configured to operate with a triangle cabling setup 808. The hang line 268 may be strung through the left spool 282A, the central spool 284, and the right spool 282B. A wire rope swag 274 may be used to form a loop or hang line eyelet 272. The hang line 268 may then be attached 810 to the guide 208 using the ring 266. A hang line shackle 270 may be thread through the ring 266 and the hang line eyelet 272. The hang line shackle 270 may then be secured or closed. In various embodiments, a bolt or pin may be used to secure the hang line shackle 270 around the hang line eyelet 272 and the ring 266. In one embodiment, the hang line 268 may be secured directly to the shackle 236. It is understood that any method to secure the hang line 268 to the guide 208 may be used.

In various embodiments, one or more anchor hang lines 276 may be used 812. A wire rope swag may be used on one or both ends of the anchor hang line 276 to create a hang line eyelet. The anchor hang line 276 may be secured to the ring 266 using an anchor hang line shackle 278 and bolt, as discussed above. In other embodiments, the anchor hang line 276 may be secured directly to the guide shackle 236. It is understood that any method to mechanically connect the anchor hang line 276 to the guide 208 may be used. An end of the anchor hang line 276, that is not connected to the guide 208, may be connected to one or more fixed points 812. For example, a hang line eyelet of the anchor hang line 276 may be thread through and secured by a shackle, the shackle being affixed to an I-beam on the drill platform 100. Any method to secure the anchor hang line to a fixed point may be used.

In various embodiments, one or more secondary guides may be used. A secondary guide 408 may be secured around the derrick cable 204 in a substantially similar method as the guide 208. A user may align the jacket components, or guide halves, around the derrick cable 204 such their securing eyelets 442 substantially align 814.

In some embodiments, a secondary guide cable attachment 436 may be aligned 816 with the securing eyelets 442. The eyelets of the secondary guide cable attachment 436 may substantially align with the openings of the securing eyelets 442.

The guide halves of the secondary guide 408 may be mechanically secured 818. In various embodiments, a bolt 438 may be thread through the one or more securing eyelets 442 of the secondary guide's 408 guide halves. The bolt 438 may additionally be thread through the openings on the secondary guide cable attachment 436, thereby mechanically connecting the cable attachment 436 to the guide 408. The bolt 438 may be fitted on each end with a securing mechanism. In various embodiments, the bolt 438 may be fastened on one or both ends with a washer and/or nut. In another embodiment, the bolt may have a capped end and may be secured on the other end using a pin. It is understood that any method to secure the bolt may be used. In still another embodiment, the guide halves may be mechanically connected and secured using an industrial tape. It is understood that any method to mechanically connect and secure the two guide halves together may be used.

In various embodiments, the secondary guide cable 410, 412 may be previously connected to the secondary guide cable attachment 436, either in its manufacturing or otherwise. In other embodiments, the secondary guide cable 410, 412 may be connected to the secondary guide cable attachment 436 after the secondary guide cable attachment 436 is connected to the guide 408. In one embodiment, the guide cable 410, 412 may be screwed into the secondary guide cable attachment 436. It is understood that any method to mechanically connect the secondary guide cable attachment and the guide cable 410, 412 may be used.

The secondary guide cable 410, 412 may be inserted, or thread 820, through the hang line assembly eyelet 244 of the guide 208. The secondary guide cable 410, 412 may then be mechanically connected or secured 822 to the primary guide 208. In various embodiments, the guide cable 410, 412 may be secured 824 using one or more nuts and washers placed on the guide cable 410, 412 on either side of the hang line assembly eyelet 244. It is understood that any suitable means to mechanically connect the guide cable 410, 412 to the guide 208 may be used.

In various embodiments, a secondary guide may or may not be used. In instances where a secondary guide cable is not attached, the hang line assembly eyelet 244 may alternatively be used to secure another shackle. The shackle may be secured in a substantially similar manner to that described above. The shackle may alternatively or additionally be used for one or more attachments to the hang line assembly.

Various embodiments of the present disclosure may be described herein with reference to flowchart illustrations and/or block diagrams of methods, apparatus (systems), and computer program products. It is understood that each block of the flowchart illustrations and/or block diagrams, and/or combinations of blocks in the flowchart illustrations and/or block diagrams, can be implemented by computer-executable program code portions. These computer-executable program code portions may be provided to a processor of a general purpose computer, special purpose computer, or other programmable data processing apparatus to produce a particular machine, such that the code portions, which execute via the processor of the computer or other programmable data processing apparatus, create mechanisms for implementing the functions/acts specified in the flowchart and/or block diagram block or blocks. Alternatively, computer program implemented steps or acts may be combined with operator or human implemented steps or acts in order to carry out an embodiment of the invention.

Additionally, although a flowchart may illustrate a method as a sequential process, many of the operations in the flowcharts illustrated herein can be performed in parallel or concurrently. In addition, the order of the method steps illustrated in a flowchart may be rearranged for some embodiments. Similarly, a method illustrated in a flow chart could have additional steps not included therein or fewer steps than those shown. A method step may correspond to a method, a function, a procedure, a subroutine, a subprogram, etc.

As used herein, the terms "substantially" or "generally" refer to the complete or nearly complete extent or degree of an action, characteristic, property, state, structure, item, or result. For example, an object that is "substantially" or "generally" enclosed would mean that the object is either completely enclosed or nearly completely enclosed. The exact allowable degree of deviation from absolute completeness may in some cases depend on the specific context. However, generally speaking, the nearness of completion will be so as to have generally the same overall result as if absolute and total completion were obtained. The use of "substantially" or "generally" is equally applicable when used in a negative connotation to refer to the complete or near complete lack of an action, characteristic, property, state, structure, item, or result. For example, an element, combination, embodiment, or composition that is "substantially free of" or "generally free of" an ingredient or element may still actually contain such item as long as there is generally no measurable effect thereof.

In the foregoing description various embodiments of the present disclosure have been presented for the purpose of illustration and description. They are not intended to be exhaustive or to limit the invention to the precise form disclosed. Obvious modifications or variations are possible in light of the above teachings. The various embodiments were chosen and described to provide the best illustration of the principals of the disclosure and their practical application, and to enable one of ordinary skill in the art to utilize the various embodiments with various modifications as are suited to the particular use contemplated. All such modifications and variations are within the scope of the present disclosure as determined by the appended claims when interpreted in accordance with the breadth they are fairly, legally, and equitably entitled.

What is claimed is:

1. A stabilizer for a line, the stabilizer comprising:

a guide configured for arrangement on the line to resist and/or dampen lateral motions of the line, the guide comprising:

a pair of guide jacket components, each of the guide jacket components comprising:

a central body portion having a static wear-resistant liner configured to guide the line as the line passes through the guide;

a flange portion extending from the central body portion and configured for coupling the guide jacket component to another guide jacket component of the pair by way of:

another flange on the another guide jacket component; and a coupling fastener, wherein the flange and the another flange are arranged to allow for coupling of a hanger assembly line with the coupling fastener.

2. The stabilizer of claim 1, further comprising a fortifying bracket configured to reinforce the guide jacket and configured to interface with a hanging system to support the guide jacket and maintain the guide jacket in position on the line.

3. The stabilizer of claim 2, wherein the fortifying bracket comprise a plurality of fortifying bracket components configured for removable arrangement on the line.

4. The stabilizer of claim 3, wherein the plurality of fortifying bracket components comprises a pair of fortifying bracket components.

5. The stabilizer of claim 2, wherein the fortifying bracket is at least partially encased by the guide jacket.

6. The stabilizer of claim 5, wherein the fortifying bracket is substantially fully encased by the guide jacket.

7. The stabilizer of claim 2, wherein the fortifying bracket is arranged on an outer surface of the guide jacket.

8. The stabilizer of claim 7, wherein the guide jacket comprises a securing groove on an outer surface thereof and a portion of the fortifying bracket nestably engages the securing groove.

9. The stabilizer of claim 1, wherein the guide jacket comprises a wear mark configured to indicate an amount of wear experienced by the guide jacket.

10. The stabilizer of claim 1, wherein the guide jacket comprises a wear mark arranged about the sleeve to indicate an increase in diameter of the sleeve and/or openings thereof.

11. The stabilizer of claim 1, further comprising a hang line assembly.

12. The stabilizer of claim 11, wherein the hang line assembly comprises a triangle cabling setup operably configured to allow the guide to move side-to-side.

13. The stabilizer of claim 12, wherein the line is a line being spooled on and off of a winch drum and the triangle cabling setup is configured to allow the guide to travel back and forth along the axis of the winch drum.

14. The stabilizer of claim 1, wherein the sleeve includes a taper.

15. The stabilizer of claim 1, wherein the wear-resistant liner comprises a weld-deposited weld layer on an inner surface thereof.

16. The stabilizer of claim 1, further comprising a separating standoff extending from the central body portion and configured to maintain a gap between the flange and the another flange of the another guide jacket component, the gap configured to receive the hanger assembly line.

17. The stabilizer of claim 16, wherein the pair of guide jacket components are simultaneously secured to one another and suspended by a hanger assembly by positioning of the coupling fastener through the flange and the another flange and through a loop in the line.

* * * * *